US006703194B2

(12) United States Patent
Yamashita

(10) Patent No.: US 6,703,194 B2
(45) Date of Patent: Mar. 9, 2004

(54) SILVER HALIDE GRAINS, SILVER HALIDE EMULSION, AND SILVER HALIDE COLOR PHOTOGRAPHIC PHOTOSENSITIVE MATERIAL

(75) Inventor: Seiji Yamashita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/025,687

(22) Filed: Dec. 26, 2001

(65) Prior Publication Data

US 2002/0142255 A1 Oct. 3, 2002

(30) Foreign Application Priority Data

Dec. 27, 2000 (JP) ..... 2000-398897

(51) Int. Cl.[7] ..... G03C 1/005; G03C 1/494
(52) U.S. Cl. ..... 430/567; 430/569; 430/449
(58) Field of Search ..... 430/567, 569, 430/449

(56) References Cited

U.S. PATENT DOCUMENTS

| | | | | | |
|---|---|---|---|---|---|
| 5,494,789 | A | * | 2/1996 | Daubendiek et al. | 430/567 |
| 5,503,971 | A | * | 4/1996 | Daubendiek et al. | 430/567 |
| 5,576,168 | A | * | 11/1996 | Daubendiek et al. | 430/567 |
| 5,614,358 | A | * | 3/1997 | Wilson et al. | 430/567 |
| 6,001,543 | A | * | 12/1999 | Asami et al. | 430/567 |
| 6,033,831 | A | * | 3/2000 | Ikeda et al. | 430/363 |
| 6,107,018 | A | * | 8/2000 | Mydlarz et al. | 430/567 |
| 6,300,050 | B1 | * | 10/2001 | Dankosh et al. | 430/567 |
| 6,518,009 | B1 | * | 2/2003 | Mydlarz et al. | 430/567 |

* cited by examiner

*Primary Examiner*—Geraldine Letscher
(74) *Attorney, Agent, or Firm*—Sughrue Mion, PLLC

(57) ABSTRACT

The present invention provides silver halide grains in which a difference in ionic conductivity between a region exhibiting highest ionic conductivity and a region exhibiting lowest ionic conductivity is at least 100 times. The invention also provides a silver halide emulsion comprising the silver halide grains as well as a silver halide color photographic photosensitive material comprising the silver halide emulsion.

22 Claims, No Drawings

SILVER HALIDE GRAINS, SILVER HALIDE EMULSION, AND SILVER HALIDE COLOR PHOTOGRAPHIC PHOTOSENSITIVE MATERIAL

BACKGROUND OF THE INVENTION

1. Field of the Present Invention

The present invention relates to silver halide grains, a silver halide emulsion and a silver halide color photographic photosensitive material. More specifically, it relates to silver halide grains, a silver halide emulsion and a silver halide color photographic photosensitive material which are excellent for high-intensity exposure use, capable of being processed at a high speed and suited for obtaining high-quality images.

2. Description of the Related Art

In recent years, methods for forming images by exposing a recording material with a laser or LED light source in accordance with digital image information for a short period of time (high intensity) have increasingly become more widespread in the field of silver halide photosensitive materials. In particular, high-quality images are offered using color photographic printing paper as a laser recorded material.

It has been well known in the field that it is necessary for photosensitive materials to have satisfactory gradation with high sensitivity in high-intensity exposure from a low-density area to a high-density area when conducting superhigh-intensity exposure for less than $10^{-4}$ seconds.

Because rapid processability has always been demanded of such photosensitive materials, silver chloride exhibiting high solubility, high-speed development and high-speed bleach-fixation has been widely used. Silver chloride has high ionic crystallinity and low ionic conductivity. This high ionic crystallinity allows a state in which an electron is trapped in an electron-trapping center to be easily stabilized by electron-lattice interaction.

Accordingly, in many cases, electron residence time in an electron-trapping center is prolonged, which poses a problem in that a phenomenon called latent image sensitization occurs with time after exposure, and hence it becomes difficult to obtain a stable image.

Further, since the silver chloride has low ionic conductivity, problems arise in that, during a sensitizing process, silver ions are not satisfactorily supplied when forming a latent image, whereby inefficiency such as latent image dispersion or recombination is triggered, thus leading to occurrence of low sensitivity or soft gradation enhancement.

In order to solve the problems described above, a primary electron-trapping center is utilized. However, there has been the problem that, in many cases, latent image sensitization described above cannot be suppressed.

In order to increase the ionic conductivity of silver chloride, a method using silver chloroiodide or silver chlorobromide has been widely used. However, there has been the problem that use of these materials in large amounts not only impairs rapid processing, but also induces low sensitivity and soft gradation enhancement due to introduction of crystal defects caused by formation of junction among different kinds of silver halides, whereby good photographic performance cannot be obtained.

Because of the aforementioned problems, silver halide grains in which the ionic conductivity thereof has been increased by at least 100 times relative to a silver chloride base have not yet been actually used as a photographic photosensitive material.

SUMMARY OF THE PRESENT INVENTION

An object of the present invention is to offer a solution to the above problems associated with the related art and to achieve the following goals.

That is, an object of the present invention is to provide silver halide grains, a silver halide emulsion and a silver halide color photographic photosensitive material, which are suitable for high-intensity exposure (digital exposure), have high pressure resistance during development, are capable of being processed at a high speed (mass processing), and with which can be realized a high-image-quality print system.

Means for solving the aforementioned problems are as follows.

<1> Silver halide grains, wherein a difference in ionic conductivity between a region exhibiting highest ionic conductivity and a region exhibiting lowest ionic conductivity is at least 100 times.

<2> A silver halide emulsion containing the silver halide grains described in <1>.

<3> A silver halide color photographic photosensitive material containing the silver halide emulsion described in <2>.

Silver Halide Grains and Silver Halide Emulsion

High-intensity reciprocity law failure of a silver halide photographic emulsion occurs when a large number of photoelectrons is generated within silver halide grains during high-intensity exposure and latent image dispersion is caused. High-intensity reciprocity law failure can be reduced by making silver halide grains to exhibit such a function within the grains that a large number of photoelectrons generated by high-intensity exposure are temporally escaped from a conduction band, and after a certain period of time of residence are re-released in a conduction band. This process corresponds to changing the condition within silver halide grains during high-intensity exposure to the same condition during low-intensity exposure.

The function of temporally escaping the photoelectrons, namely the function of temporally trapping photoelectrons, can be realized by doping a transition metal complex into silver halide grains. Such a dopant is referred to as an electron slowly-releasing dopant or an illumination-conversion dopant.

Hexachloroiridium has been so far used as a transition metal complex capable of reducing high-intensity reciprocity law failure. When hexachloroiridium is used, photoelectrons generated by exposure are trapped in the lowest vacant orbit of iridium serving as a central metal, and after a certain period of time of residence are re-released into the conduction band. The time from the commencement of exposure to re-release of the trapped photoelectrons is defined as an electron residence time.

The electron residence time can be determined by a reciprocity curve or a double flash photoconduction method. In the present invention, it was determined by a reciprocity curve which can be created as described on page 297 of "*Kaitei Shashin Kogaku no Kiso: Gin-en Shashin-hen* (Fundamentals of Photographic Science and Engineering (Revised): Silver Photography)", edited by the Society of Photographic Science and Technology of Japan, Corona Publishing Co., Ltd., 1998.

When an ordinary silver halide emulsion (specifically, a silver chloride emulsion) is used, higher sensitivity occurs approximately at an intermediate illumination intensity region, with a reduced sensitivity both at a low illumination intensity region and a high illumination intensity region, thereby creating a convex curve with respect to the bottom of the graph. In contrast, if an emulsion which has reduced high-intensity reciprocity law failure by doping an electron slowly-releasing dopant is used, sensitivity does not decrease in regions higher than a certain exposure intensity and a reciprocity curve is flattened in the regions. That is, another reciprocity curve is obtained with an emulsion in which a dopant is not contained. The exposure illumination intensity at which the flattening starts, namely an exposure time at the intensity at which a difference occurs from the curve obtained with another emulsion without doping, is defined as electron residence time.

Since the effect of electron slowly-releasing (photoelectron re-releasing) emerges upon termination of the exposure, the time at which the effect of electron slowly-releasing appears photographically can be defined as the time at which electron re-releasing starts, namely, as electron residence time.

When a light source for exposure is fixed, an electron residence time corresponding to only a certain exposure intensity may be set. However, in order to obtain an emulsion that always achieves the same photographic characteristics even when different light sources are used, it is necessary to introduce dopants having appropriate electron residence times in accordance with the intensity of respective light sources for exposure into silver halide grains.

Not only illumination-conversion dopants, but also existing hard gradation enhancing dopants or high sensitization dopants can be discussed similarly in terms of the electron residence time. Hard gradation enhancing dopants allow trapping of the photoelectrons generated by exposure at a dopant site, and exhibit increased gradation enhancement by not re-releasing the photoelectrons but by releasing the electrons after quite a long period of time (a few hours to a few years) from the point of trapping photoelectrons.

High sensitization dopants such as hexacyanoferrate, as described in *Bulgarian Chemical Communications*, 1993, Vol. 20, pp. 350–368, in *Radiation Effects and Defects in Solids* 135 (1995), pp. 101-104, and in *Journal of Physics: Condensed Matter* 9 (1997), pp. 3227–3240, introduce a shallow electron trap via the Coulomb field into silver halide grains, whereby a dopant site has quite a short slowly-releasing time to repeat trapping and releasing of photoelectrons. As a result, photoelectrons can stay in the conduction band without exerting apparent deactivation for a certain time until interlattice silver ions are supplied or until photoelectrons can migrate to interlattice silver ions, to thus achieve high sensitization.

As stated above, the concept of the electron residence time is important for photographic properties. If a dopant exhibiting an appropriate slowly-releasing time is adequately used in combination, a silver halide emulsion which has an intentionally controlled sensitivity, gradation and reciprocity characteristics can be designed. However, examples of disclosures which discuss photographic properties in terms of an electron residence time have not yet been found.

DESCRIPTION OF THE PREFERRED EMBODIMENTS

It is preferable for the silver halide grains of the present invention to have a difference in ionic conductivity between a region exhibiting highest ionic conductivity and a region exhibiting lowest ionic conductivity by at least 100 times. This difference in ionic conductivity is more preferably 100 to 1,000 times, and even more preferably 150 to 500 times.

In order to evaluate ionic conductivity, the dielectric loss method is preferably employed. The dielectric loss method is described in detail in "*Kaitei Shashin Kogaku no Kiso: Gin-en Shashin-hen* (Fundamentals of Photographic Science and Engineering (Revised): Silver Photography)", edited by the Society of Photographic Science and Technology of Japan.

Dielectric loss can be measured using a method disclosed in the *Journal of the Society of Photographic Science and Technology of Japan*, Vol. 44(1981).

Incidentally, "a difference in ionic conductivity by at least 100 times" in the present invention means that an apparent difference in frequency at a peak of dielectric loss is at least 100 times.

The term "a region exhibiting a difference in ionic conductivity" means the region representing a certain characteristic phase, more preferably the region having a core and a shell in a core/shell structure to be described later, or, in case where plural shells are present, regions of a shell and another shell.

In a preferred embodiment, the silver halide grains of the present invention have a primary electron-trapping center exhibiting an average electron residence time of from $1/10{,}000$ second to $1/100$ second, and in a more preferred embodiment, the silver halide grains have the primary electron-trapping center in a region which exerts lowest ionic conductivity.

The average residence time when the transition metal complex traps electrons is largely affected not only by its own properties but also by the basic halogen composition, and is determined by the combination thereof. In the present invention, the average electron residence time is preferably within a range from $1/10{,}000$ second to $1/100$ second, more preferably from $1/3{,}000$ second to $1/100$ second.

Further, the dopant which have such an electron residence time needs to be doped (contained) in the region exhibiting lowest ionic conductivity where an ionic process hardly occurs. When an ionic process occurs, electrons will combine with silver ions at this region to cause formation of silver nuclei. As a result, an internal latent image might be formed to thereby become inefficient. The ionic conductivity may greatly vary with the halogen composition. If the silver bromide content is higher than the silver chloride content, the ion conductivity becomes higher. Further, if the silver iodide content is higher than the silver bromide content, the ion conductivity becomes much higher. Accordingly, it is particularly preferable for the illumination-conversion dopant to be doped into a layer having a higher silver chloride content.

Preferable examples of transition metal complexes as a illumination-conversion dopant for use in the present invention, which are incorporated into the interior or on the surface of silver halide grains at a step in which the silver halide grains are formed and/or grown, are listed below.

Preferable examples of metal ions for use as the central metal of transition metal complexes include iron, ruthenium, iridium, osmium, lead, cadmium and zinc. It is preferable that these metal ions are accompanied by a ligand and that the metals are used as the hexacoordinate octahedral complex. When inorganic compounds are used as the ligands, preferable examples thereof include a cyanide ion, a halide ion, thiocyan, a hydroxide ion, a peroxide ion, an azide ion, a nitrite ion, water, ammonia, a nitrosyl ion and a thionitrosyl ion.

The ligands may be coordinated with any kind of the above-mentioned ions of metals. Ligands of the same type may be coordinated in the coordination sites of the ion of the metal, or ligands of different types may be coordinated therein at the same time.

Further, organic compounds may also be used as ligands. When organic compounds are used as ligands, linear compounds whose main chain have 5 or less carbon atoms and/or 5-membered or 6-membered heterocyclic compounds are preferable. Among these compounds, the compounds containing a nitrogen, phosphorus, oxygen or sulfur atom in the molecule as an atom coordinating to a metal are more preferable. In more detail, furan, thiophene, oxazole, isoxazole, thiazole, isothiazole, imidazole, pyrazole, triazole, furazane, pyran, pyridine, pyridazine, pyrimidine and pyrazine are particularly preferable. Further, the compounds which comprise any of the above-mentioned compounds as basic skeletons and substituents introduced thereto are also preferable.

The transition metal complex is incorporated in an amount of preferably $1\times10^{-10}$ to $1\times10^{-2}$ mol, more preferably $1\times10^{-8}$ to $1\times10^{-5}$ mol per mol of silver. Details of transition metal complexes will be described later.

The silver halide emulsion of the present invention is characterized in that the emulsion contains the silver halide grains of the present invention. Preferable examples of silver halide grains contained in the silver halide emulsion of the present invention include cubic grains substantially having {100} plane, tetradecahedral crystal grains (the grains may have a round apex and a plane of a further higher order), octahedral crystal grains or tabular grains which have an aspect ratio of at least 2 characterized in that at least 50% of the total projected area thereof is made up of a {100} plane or a {111} plane. The aspect ratio used herein is a value obtained by dividing the equivalent-circle diameter of the projected area of a grain by the grain thickness.

In the present invention, cubic grains, tabular grains having a {100} plane as a principal plane or tabular grains having a {111} plane as a principal plane are preferably used.

As the silver halide emulsion for use in the present invention, a silver chloride, silver bromide, silver iodobromide and silver chloro(iodo)bromide emulsion or the like can be used. From the standpoint of rapid processability, a silver chloride, silver chlorobromide, silver chloroiodide or silver chlorobromoiodide emulsion, each having a silver chloride content of 95 mol % or more is preferable, and a silver chloride, silver chlorobromide, silver chloroiodide or silver chlorobromoiodide emulsion, each having a silver chloride content of 98 mol % or more is more preferable.

Among these silver halide emulsions, an emulsion which is composed of silver halide grains whose shell portions have a silver iodochloride phase that makes up preferably 0.01 to 0.50 mol %, more preferably 0.05 to 0.40 mol % per total mol of silver is further preferable because such an emulsion exhibits high sensitivity and excellent suitability to high-intensity exposure. Incidentally, the "shell portions" used herein means an outer shell portion of the silver halide grain that occupies a volume ratio of 0 to 30%.

Further, an emulsion which is composed of silver halide grains having on the surface thereof a localized silver bromide phase that makes up preferably 0.2 to 5 mol %, more preferably 0.5 to 3 mol % per total mol of silver is particularly preferable because such an emulsion exhibits high sensitivity and stabilized photographic performances.

It is preferable that the silver halide emulsion of the present invention contains silver iodide. As a method of introducing an iodide ion, a method in which an iodide salt solution is added singly or a method in which an iodide salt solution is added simultaneously with the addition of a silver salt solution and a chloride-rich salt solution may be employed. In the latter case, a method in which an iodide salt solution and a chloride-rich salt solution are added separately or a method in which a mixed solution of an iodide salt and a chloride-rich salt is added may be employed.

The iodide salt is added in a form of a soluble salt such as an alkali or an alkaline earth metal iodide. Otherwise, a method of introducing an iodide by cleaving an organic molecule to obtain an iodide ion as described in U.S. Pat. No. 5,389,508 can also be employed. Alternatively, fine silver iodide grains can also be used as another iodide ion source.

The addition of the iodide salt solution may be concentrated on one point of time during formation of grains or may be spread over a certain period of time. The sites into which the iodide ions are introduced in a chloride-rich emulsion grain are limited from the standpoint of obtaining an emulsion having high sensitivity and producing little fogging. The deeper the introduction site inside the grain interior, the smaller the sensitivity enhanced obtained. Accordingly, the addition of the iodide salt solution is commenced from sites preferably outside of more than 50%, more preferably more than 70%, most preferably more than 80%, of the grain volume.

Moreover, the addition of the iodide salt solution is completed at sites lying preferably inside of at least 98% of the grain volume, preferably inside of at least 96% of the grain volume. An emulsion having a higher sensitivity and producing less fogging can be obtained by completing the addition of the iodide salt solution at sites slightly inward from the grain surface.

The distribution of the iodide ion concentration in the direction of depth of the grain can be measured by etching/TOF-SIMS (Time of Flight—Secondary Ion Mass Spectrometry) method using, for example, a model TRIFT II TOF-SIMS, manufactured by Phi Evans Corp. Details of TOF-SIMS method are described in "*Hyomen Bunseki Gijutsu Sensho Niji Ion Shitsuryo Bunseki-Ho* (*Surface Analysis Technology Selected Book Secondary Ion Mass Spectrometry*)", edited by Japan Surface Science Association, Maruzen Co. Ltd. (1999).

Analysis of emulsion grains by means of etching/TOF-SIMS method reveals that iodide ions exude toward the grain surface even if the addition of the iodide salt solution finishes at a site inside the grain. When the silver halide emulsion of the present invention contains silver iodide, it is preferable that in the analysis by means of etching/TOF-SIMS method the iodide ion concentration has a maximum on the grain surface and the iodide ion concentration attenuates toward the grain interior.

It is preferable that the silver halide emulsion of the present invention has a localized silver bromide phase.

When the silver halide emulsion of the present invention has a localized silver bromide phase, it is more preferable that a localized silver bromide phase having a silver bromide content of at least 10 mol % is epitaxially grown and formed on the grain surface. It is further preferable that an outermost shell portion having a silver bromide content of 1 mol % or more is present near the grain surface.

The silver bromide content in the localized silver bromide phase is preferably 1 to 80 mol %, more preferably 5 to 70 mol %. The localized silver bromide phase is made up preferably 0.1 to 30 mol %, more preferably 0.3 to 20 mol % of silver based on the total mol of silver constituting the silver halide grains of the present invention.

It is preferable to incorporate a complex compound of a Group VIII metal such as iridium (III) chloride, iridium (III) bromide, iridium (IV) chloride, sodium hexachloroiridate (III), potassium hexachloroiridate (IV), hexaammineiridium (IV) salt, trioxalatoiridium (III) salt or trioxalatoiridium (IV) salt into the localized silver bromide phase. The amounts of these compounds to be added may vary within a wide range depending on purposes, and preferably are $10^{-9}$ to $10^{-2}$ mol per mol of silver halide.

The transition metal complex is described in more detail below.

In the transition metal complex, a preferred combination of the metal ion as the central metal and the ligand is the combination of an iron ion and a cyanide ion and the combination of a ruthenium ion and a cyanide ion. In these combinations, it is more preferable that the cyanide ions account for the majority of a coordination number of the iron or ruthenium that is the central metal, such that the remaining coordination sites are occupied by thiocyan, ammonia, water, a nitrosyl ion, dimethyl sulfoxide, pyridine, pyrazine or 4,4'-bipyridine. It is most preferable that the formation a hexacyanoferrate complex or a hexacyanoruthenate complex such that all of the 6 coordination sites of the central metal are occupied by cyanide ions.

The amount of the transition metal complex that has cyanide ions as ligands and is to be added during formation of silver halide grains is preferably $1\times10^{-8}$ to $1\times10^{-2}$ mol per mol of silver, more preferably $1\times10^{-6}$ to $5\times10^{-4}$ mol per mol of silver.

When iridium is used as the central metal, preferred examples of the ligand include a fluoride ion, a chloride ion, a bromide ion and an iodide ion. Among these ions, a chloride ion or a bromide ion is more preferable.

Preferable examples of transition metal complexes using iridium as the central metal (hereinafter sometimes referred to as an "iridium complex") include $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{31}$ , $[IrCl_4(H_2O)_2]^{0}$, $[IrCl_3(H_2O)_3]^{0}$,$[IrCl_3(H_2O)_3]^{+}$,$[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$ and $[IrBr_3(H_2O)_3]^{+}$.

The amount of the iridium complex to be added during formation of silver halide grains is preferably $1\times10^{-10}$ to $1\times10^{-3}$ mol, more preferably $1\times10^{-8}$ to $1\times10^{-5}$ mol per mol of silver.

When ruthenium or osmium is used as the central metal, it is preferable to use a nitrosyl ion, a thionitrosyl ion, a water molecule or a chloride ion as a ligand in combination. For example, it is more preferable to form a pentachloronitrosyl complex, a pentachlorothionitrosyl complex or a pentachloroaqa complex and also preferable to form a hexachloro complex.

The amount of the transition metal complex having ruthenium or osmium as the central metal (hereinafter sometimes referred to as a "ruthenium complex" or an "osmium complex") to be added during formation of silver halide grains is preferably $1\times10^{-10}$ to $1\times10^{-6}$ mol, more preferably $1\times10^{-9}$ to $1\times10^{-6}$ mol per mol of silver.

It is preferable to incorporate the transition metal complex into the silver halide grains of the present invention by addition of the metal complex directly into a reaction solution at the time of forming the silver halide grains or by addition of the metal complex into the grain-forming reaction solution through addition of the metal complex to a halide aqueous solution for silver halide grain formation or another solution. It is also preferable to incorporate the metal complex into the silver halide grains by a combination of these methods.

When the transition metal complex is incorporated into the silver halide grain, it is preferable that the transition metal complex is uniformly present within the grain. It is also preferable that the transition metal complex is present only in the grain surface layer, as disclosed in Japanese Patent Laid-Open Nos. 208,936/1992, 125,245/1990 and 188,437/1991, and that the transition metal complex is incorporated into the grain interior so that the grain surface is covered with a layer which does not contain the metal complex.

Further, as disclosed in U.S. Pat. Nos. 5,252,451 and 5,256,530, it is preferable that the grain surface phase is modified by physical ripening using fine grains having the transition metal complex incorporated into the grain interior. Moreover, it is possible to use these methods in combination, and plural kinds of transition metal complexes may be incorporated into one silver halide grain. The halogen composition of the site at which the transition metal complex is incorporated is not particularly limited, and the transition metal complex may be incorporated into any of a silver chloride layer, a silver chlorobromide layer, a silver bromide layer, a silver iodochloride layer and a silver iodobromide layer.

The average grain size (the number average of grain sizes defined by a diameters of circles equivalent to projected areas of the grains) of the silver halide grains to be contained in the silver halide emulsion of the present invention is preferably 0.1 $\mu$m to 2 $\mu$m.

Further, the grain size distribution is preferably a so-called monodispersed one whose variation coefficient (a value obtained by dividing the standard deviation of the grain size distribution by the average grain size) is preferably 20% or less, more preferably 15% or less, particularly preferably 10% or less. In this case, to obtain a broad latitude, it is preferable to form a single layer using a blend of two or more kinds of the monodispersed emulsions, or to form multiple layers.

The silver halide emulsion of the present invention may contain various compounds or precursors thereof for preventing fogging during manufacture of a silver halide color photographic photosensitive material, during storage thereof, during photographic processing thereof, or for stabilizing photographic performances thereof. Preferable examples of these compounds are described in Japanese Patent Laid-Open No. 215,272/1987, pages 39 to 72. Further, 5-arylamino-1,2,3,4-thiatriazole compounds (the aryl residue has at least one electron attractive group) described in EP 0,447,647 are also preferably used.

In the silver halide emulsion of the present invention, hydroxamic acid derivatives described in Japanese Patent Laid-Open No. 109,576/1999, cyclic ketones having a double bond which adjoins to a carbonyl group and whose both ends are substituted with an amino group or a hydroxyl group (compounds represented by the general formula (S1) in paragraphs [0036] to [0071]) of Japanese Patent Laid-Open No. 327,094/1999, sulfo-substituted catechols or hydroquinones (for example, 4,5-dihydroxy-1,3-benzenedisulfonic acid, 2,5-dihydroxy-1,4-benzenesulfonic acid, 3,4-dihydroxybenzenesulfonic acid, 2,3-dihydroxybenzenesulfonic acid, 2,5-dihydroxy- benzenesulfonic acid, 3,4,5-trihydroxybenzenesulfonic acid and salts thereof) described in Japanese Patent Laid-Open No. 143,011/1999, hydroxylamines represented by the general formula (A) of U.S. Pat. No. 5,556,741 (the description in U.S. Pat. No. 5,556,741, column 4, line 56 to column 11, line 22 is also preferably applicable to the present invention) and water-soluble reducing agents represented by the general formulas (I) to (III) of Japanese Patent Laid-Open No. 102,045/1999 are preferably used for increasing storability of the emulsion.

Silver Halide Color Photographic Photosensitive Material

The silver halide color photographic photosensitive material (hereinafter, occasionally referred to simply as a "photosensitive material") of the present invention is described below.

The silver halide color photographic photosensitive material of the present invention is characterized by containing the silver halide emulsion of the present invention.

In the silver halide color photographic photosensitive material of the present invention, each layer is subjected to spectral sensitization in order to impart spectral sensitivity to the silver halide emulsion contained in the layer so that the emulsion can exhibit sensitivity to light within a desirable wavelength region.

As spectral sensitizing dyes used for spectral sensitization in blue, green and red regions, for example, the dyes described in F. M. Harmer, Heterocyclic Compounds—Cyanine Dyes and Related Compounds (John, Wiley &, Sons, New York, London, 1964) are preferably used in the silver halide color photographic photosensitive material of the present invention.

Preferable examples of compounds and spectral sensitizing methods are described in Japanese Patent Laid-Open No. 215,272/1987, page 22, right upper column to page 38. Further, as a red-photosensitive spectral sensitizing dye for silver halide emulsion grains having a high silver chloride content, the spectral sensitizing dye described in Japanese Patent Laid-Open No. 123,340/1991 are specifically preferable from the standpoints of stability, strength of adsorption and temperature dependence at exposure.

The amounts of these spectral sensitizing dye to be added may vary within a wide range as required, and preferably $0.5\times10^{-6}$ to $1.0\times10^{-2}$ mol, more preferably $1.0\times10^{-6}$ to $5.0\times10^{-3}$ mol per mol of silver halide.

The silver halide emulsion of the present invention is usually chemically sensitized. As the chemical sensitizing method, sulfur sensitization such as representatively conducted by addition of an unstable sulfur compound, noble metal sensitization such as by gold sensitization and reduction sensitization can be used either singly or in combination.

As compounds used for chemical sensitization, those described in Japanese Patent Laid-Open No. 215,272/1987, page 18, right lower column to page 22, right upper column are preferably used. Among these, the compounds for use in gold sensitization are more preferable because gold sensitization can further decrease the change of the photographic performance in scanning exposure with a laser beam.

For the silver halide emulsion of the present invention to be subjected to gold sensitization, various inorganic gold compounds, gold (I) complexes having inorganic ligands and gold (I) compounds having organic ligands can be used. Preferable examples of inorganic gold compounds include chloroauric acid and the salts thereof, and preferable examples of the gold (I) complexes having inorganic ligands include dithiocyanic acid gold compounds such as gold (I) potassium dithiocyanate and dithiosulfuric acid gold compounds such as gold (I) trisodium dithiosulfate.

As the gold (I) compounds having organic ligands, bis gold (I) mesoionic heterocyclic compounds such as bis(1,4,5-trimethyl-1,2,4-triazolium-3-thiolate)gold(I) tetrafluoborate as described in Japanese Patent Laid-Open No. 267,249/1992, organic mercapto gold (I) complexes such as potassium bis(1-[3-(2-sulfonatobenzamide)phenyl]-5-mercaptotetrazole potassium salt) aurate(I)pentahydrate as described in Japanese Patent Laid-Open No. 218,870/1999 and gold (I) compounds coordinated with a nitrogen compound anion, such as sodium bis(1-methylhydantoinato) gold(I)tetrahydrate as described in Japanese Patent Laid-Open No. 268,550/1992 can be used.

Further, gold (I) thiolate compounds described in U.S. Pat. No. 3,503,749 and gold compounds described in Japanese Patent Laid-Open Nos. 69,074/1996, 69,075/1996 and 269,554/1997 and compounds described in U.S. Pat. Nos. 5,620,841, 5,912,112, 5,620,841, 5,939,245 and 5,912,111 are also usable.

The amounts of these compounds to be added can vary within a wide range as required, and are preferably $5\times10^{-7}$ to $5\times10^{-3}$ mol, more preferably $5\times10^{-6}$ to $5\times10^{-4}$ mol per mol of silver halide.

When conducting gold sensitization, colloidal gold sulfide can also be used. The method of producing the same is described in Research Disclosure, 37154, Solid State Ionics, vol. 79, pp. 60–66, 1995 and Compt. Rend. Hebt. Seances Acad. Sci. Sect. B, vol. 263, p. 1328, 1996. As colloidal gold sulfide, those having various sizes may be used, and colloidal gold sulfide having a grain size of less than 50 nm may also be used. The amount of colloidal gold sulfide to be added can vary within a wide range as required. It is $5\times10^{-7}$ to $5\times10^{-3}$ mol, preferably $5\times10^{-6}$ to $5\times10^{-4}$ mol in terms of gold atom, per mol of silver halide.

In the present invention, it is preferable that the gold sensitization is combined with another sensitization, for example, sulfur sensitization, selenium sensitization, tellurium sensitization, reduction sensitization or noble metal sensitization using a noble metal other than a gold compound.

In the silver halide color photographic photosensitive material of the present invention, conventionally known photographic materials or additives can be used.

As a photographic support, for example, a transmissive support or a reflective support can be used.

As a transmissive support, preferably used are a transparent film such as a cellulose nitrate film or a polyethylene terephthalate film and a polyester support which is made from 2,6-naphthalenedicarboxylic acid (NDCA) and ethylene glycol (EG) or from NDCA, terephthalic acid and EG, and which has an information recording layer such as a magnetic layer.

As a reflective support, a support laminated with plural layers of polyethylene layers or polyester layers such that at least one of these water-resistant resin layers (laminate layers) contains a white pigment such as titanium oxide, is preferable.

In the present invention, a more preferable reflective support is a support on which a polyolefin layer having fine pores has been provided on one face of the paper base bearing the silver halide emulsion layer. The polyolefin layer may be formed of plural layers. In this case, it is specifically preferable that a polyolefin (for example, polypropylene or polyethylene) layer next to a gelatin layer on the face bearing the silver halide emulsion layer does not have fine pores, and a polyolefin (for example, polypropylene or polyethylene) layer having fine pores is at the site closer to the paper base.

The density of the polyolefin multilayer or single layer, which lies between the paper base and the photographic constituent layer, is preferably 0.40 to 1.0 g/ml, more preferably 0.50 to 0.70 g/ml.

Further, the thickness of the polyolefin multilayer or single layer, which lies between the paper base and the photographic constituent layer is preferably 10 to 100 μm, more preferably 15 to 70 μm. Moreover, the thickness ratio of the polyolefin layer to the paper base is preferably 0.05 to 0.2, more preferably 0.1 to 0.15.

In order to increase rigidity of the reflective support, it is preferable that the polyolefin layer is formed on the reverse face (back), which is opposite to the photographic constituting layer face, of the paper base. In this case, as the polyolefin layer on the back, a polyethylene or polypropylene layer having a matte surface is preferable. Of these, a polypropylene layer is more preferable.

The thickness of the polyolefin layer on the back is preferably 5 to 50 μm, more preferably 10 to 30 μm. Moreover, the density of the polyolefin layer on the back is preferably 0.7 to 1.1 g/ml.

In the reflective support of the present invention, preferable examples of the polyolefin layer formed on the paper base are described in Japanese Patent Laid-Open Nos. 333,277/1998, 333,278/1998, 52,513/1999 and 65,024/1999, EP 0,880,065 and EP 0,880,066.

In addition, it is preferable that the water-resistant resin layer (laminate layer) contains a fluorescent brightener. The fluorescent brightener may be dispersed in the hydrophilic colloid layer of the silver halide color photographic photosensitive material.

As fluorescent brighteners, benzoxazole-based, coumarin-based and pyrazoline-based fluorescent brighteners are preferable. Among these, benzoxazolylnaphthalene-based and benzoxazolylstilbene-based fluorescent brighteners are preferably used.

The amount of the fluorescent brightener to be included is not particularly limited, and it is preferably 1 to 100 mg/m$^2$. The proportion of the fluorescent brightener when mixed into the water-resistant resin is preferably 0.0005 to 3% by mass, more preferably 0.001 to 0.5% by mass based on the resin.

The reflective support for use in the silver halide color photographic photosensitive material of the present invention may be formed by providing a hydrophilic colloid layer containing a white pigment on the transmissive support or the reflective support. Further, the reflective support may be a support having a metal surface exhibiting mirror reflectivity or secondary diffuse reflectivity.

The supports for use in the silver halide color photographic photosensitive material of the present invention may be a white polyester-based support or a support having a layer containing a white pigment on the silver halide emulsion layer face, for use as a display. Further, in order to improve sharpness, it is preferable to provide an antihalation layer on the silver halide emulsion layer face or on the back face of the support. Specifically, it is preferable to set the transmission density of the support to a value within the range of 0.35 to 0.8 so that the display can use both reflected light and transmitted light.

In order to improve image sharpness, it is preferable that dyes (specifically, oxonol-base dyes) that can be decolorized by processings as described in European Patent EP 0,337,490A2, pages 27 to 76, are incorporated into the hydrophilic colloid layer of the silver halide color photographic photosensitive material of the present invention such that the optical reflection density of the photosensitive material becomes at least 0.70 at 680 nm or that titanium oxide which has been surface-treated with dihydric to tetrahydric alcohols (for example, trimethylolethane) is incorporated into the water-resistant resin layer of the support in an amount of 12% by mass or more (preferably 14% by mass or more).

In order to prevent irradiation or halation or to achieve safelight safety, it is preferable that dyes (specifically, oxonol-base dyes or cyanine dyes) that can be decolorized by processings as described in European Patent EP 0,337,490A2, pages 27 to 76, are incorporated into the hydrophilic colloid layer. Further, dyes described in European Patent EP 0,819,977 are also incorporated into the photosensitive material of the present invention.

Some of these water-soluble dyes may adversely affect color separation or safelight safety if the amount used is increased. As dyes which can be used without causing undesirable effects on color separation, water-soluble dyes described in Japanese Patent Laid-Open Nos. 127,324/1993, 127,325/1993 and 216,185/1993 are more preferable.

In the present invention, a colored layer that can be decolorized by processings is used instead of the water-soluble dyes or in combination with the water-soluble dyes. The colored layer that can be decolorized by processings may be positioned in direct contact with an emulsion layer or may be positioned via an interlayer containing a color-mixing inhibitor such as gelatin or hydroquinone. It is preferable that this colored layer is provided as an subbing layer (on the support side) of an emulsion layer that is designed to develop the same kind of primary color as the colored layer. It is possible that colored layers corresponding to all primary colors may be provided separately or that colored layers corresponding to freely selected primary colors may be provided. It is also possible to provide colored layers colored in compliance with plural primary color regions.

The optical reflection density of the colored layer is set such that a value of optical density is preferably from 0.2 to 3.0, more preferably from 0.5 to 2.5, particularly preferably from 0.8 to 2.0, at a wavelength which is within a wavelength region to be used for exposure (in a visible light region of 400 nm to 700 nm for exposure by an ordinary printer, and at the wavelength of the light source for scanning exposure in the case of scanning exposure) and causes the highest optical density.

Conventionally known methods can be applied to form the colored layer. Examples thereof include a method in which a dispersion of fine solid grains of dye, such as dyes described in Japanese Patent Laid-Open No. 282,244/1990, page 3, right upper column to page 8 or dyes described in Japanese Patent Laid-Open No.7,931/1991, page 3, right upper column to page 11, left lower column, are incorporated into a hydrophilic colloid layer, a method in which an anionic dye is mordanted to a cationic polymer, a method in which a dye is immobilized inside a layer by being adsorbed on fine grains of silver halide, and a method using colloidal silver as described in Japanese Patent Laid-Open No. 239,544/1989.

As for the method for dispersing fine solid grains of the dye, for example, a method in which a fine dye powder substantially water-insoluble at most at pH 6 but water-soluble at least at pH 8 is incorporated is described in Japanese Patent Laid-Open No. 308,244/1990, pages 4 to 13. Further, a method in which an anionic dye is mordanted to a cationic polymer is described in Japanese Patent Laid-Open No. 84,637/1990, pages 18 to 26.

A method for preparing colloidal silver as a light-absorber is described in U.S. Pat. Nos. 2,688,601 and 3,459,563.

Among these methods, the method in which a fine dye powder is incorporated and the method in which colloidal silver is used are preferable.

The silver halide color photographic photosensitive material of the present invention is used for a color negative film, a color positive film, a color reversal film, a color reversal photographic printing paper, a color photographic printing paper or the like. It is preferably used for a color photographic photosensitive material comprising a reflective support, particularly preferably for a color photographic printing paper.

The color photographic printing paper preferably has at least one yellow-developing silver halide emulsion layer, at least one magenta-developing silver halide emulsion layer and at least one cyan-developing silver halide emulsion layer. Usually, the order of these silver halide emulsion layers from the support is the yellow-developing silver halide emulsion layer, the magenta-developing silver halide emulsion layer and the cyan-developing silver halide emulsion layer. However, it is also possible to provide a different layer construction.

The silver halide emulsion layer containing a yellow coupler may be provided at any position on the support. When silver halide tabular grains are contained in the yellow coupler-containing layer, it is preferable to dispose this layer at a position more distant from the support than at least one of the magenta coupler-containing silver halide emulsion layer and the cyan coupler-containing silver halide emulsion layer. Further, from the standpoints of accelerating color development, promoting desilverization and reducing residual color due to a sensitizing dye, it is more preferable that the yellow coupler-containing silver halide emulsion layer is disposed at a position remotest from the support relative to the other silver halide emulsion layers. Meanwhile, from the standpoint of reducing Blix discoloration, it is preferable that the cyan coupler-containing silver halide emulsion layer constitutes a central layer among the other silver halide emulsion layers. From the standpoint of reducing discoloration by light, it is preferable that the cyan coupler-containing silver halide emulsion layer constitutes the lowest layer.

Moreover, the yellow-, magenta- and cyan-developing layers may each be made up of two or three layers. For example, as described in Japanese Patent Laid-Open Nos. 75,055/1992, 114,035/1997 and 246,940/1998 and U.S. Pat. No. 5,576,159, it is also preferable that a coupler layer containing no silver halide emulsion is provided in a position next to a silver halide emulsion layer for use as a color-developing layer.

As the silver halide emulsion, additional materials (additives and the like) and the photographic constituent layers (layer construction and the like) that can be employed in the present invention, as well as a method and additives used for processing the silver halide color photographic photosensitive material of the present invention, those described in Japanese Patent Laid-Open Nos. 215,272/1987 and 33,144/1990 and EP 0,355,660A2 are preferably used, and those described in EP 0,355,660A2 are particularly preferably used. Further, the silver halide color photographic photosensitive materials and the processing methods therefor described in Japanese Patent Laid-Open Nos. 34,889/1993, 359,249/1992, 313,753/1992, 270,344/1992, 66,527/1993, 34,548/1992, 145,433/1992, 854/1990, 158,431/1989, 90,145/1990, 194,539/1991 and 93,641/1990 and European Patent Laid-Open No. 0,520,457A2 are also preferable.

In particular, in the silver halide color photographic photosensitive material of the present invention, the reflective supports, silver halide emulsions, kinds of different metal ions to be doped into the silver halide grains, storage stabilizers or fogging inhibitors of the silver halide emulsions, chemical sensitization methods (chemical sensitizers), spectral sensitization methods (spectral sensitizers), cyan, magenta and yellow couplers, methods of emulsifying and dispersing the couplers, color image stability improving agents (stain inhibitors or browning inhibitors), dyes (colorants), gelatins, layer constructions of photosensitive materials, pH of the coating films of the photosensitive materials, and others, each described in the patents shown in the following Table 1 can be preferably used.

TABLE 1

| Elements | Japanese Patent Laid-Open No. 104,448/1995 | Japanese Patent Laid-Open No. 77,775/1995 | Japanese Patent Laid-Open No. 301,895/1995 |
|---|---|---|---|
| Reflective support | column.7 line.12–column 12 line.19 | Column 35 line 43–column 44 line 1 | Column 5 line 40–column 9 line 26 |
| Silver halide emulsions | column 72 line.29–column 74 line 18 | Column 44 line 36–column 46 line 29 | Column 77 line 48–column 80 line 28 |
| Kinds of different metal ions | column 74 lines 19–44 | Column 46 line 30–column 47 line 5 | Column 80 line 29–column 81 line 6 |
| Storage stabilizers or fogging inhibitors | column 75 lines 9–18 | Column 47 lines 20–29 | Column 18 line 11–column 31 line 37 (specifically, mercapto heterocyclic compound) |
| Chemical sensitization method (chemical sensitizers) | column 74 line 45–column 75 line 6 | Column 47 lines 7–17 | Column 81 lines 9–17 |
| Spectral sensitization method (spectral sensitizers) | column 75 line 19–column 76 line 45 | Column 47 line 30–column 49 line 6 | Column 81 line 21–column 82 line 48 |
| Cyan couplers | column 12 line 20–column 39 line 49 | Column 62 line 50–column 63 line 16 | Column 88 line 49–column 89 line 16 |
| Yellow couplers | column 87 line 40–column 88 line 3 | Column 63 lines 17–30 | Column 89 lines 17–30 |
| Magenta couplers | column 88 lines 4–18 | Column 63 line 3–column 64 line 11 | Column 31 line 34–column 77 line 44 & column 88 lines 32–46 |
| Method of emulsifying and dispersing the couplers | column 71 line 3–column 72 line 11 | column 61 lines 36–49 | Column 87 lines 35–48 |

TABLE 1-continued

| Elements | Japanese Patent Laid-Open No. 104,448/1995 | Japanese Patent Laid-Open No. 77,775/1995 | Japanese Patent Laid-Open No. 301,895/1995 |
|---|---|---|---|
| Color image stability improving agents (stain inhibitors) | column 39 line 50–column 70 line 9 | column 61 line 50–column 62 line 49 | Column 87 line 49–column 88 line 48 |
| Browning inhibitors | column 70 line 10–column 71 line 2 | | |
| Dyes (colorants) | column 77 line 42–column 78 line 41 | column 7 line 14–column 19 line 42 & column 50 line 3–column 51 line 14 | Column 9 line 27–column 18 line 10 |
| Kinds of gelatins | column 78 lines 42–48 | column 51 lines 15–20 | Column 83 lines 13–19 |
| Layer constructions of photosensitive materials | column 39 lines 11–26 | column 44 lines 2–35 | Column 31 line 38–column 32 line 33 |
| pH of the coating films of photosensitive materials | column 72 lines 12–28 | | |
| Scanning exposure | column 76 line 6–column 77 line 41 | column 49 line 7–column 50 line 2 | Column 82 line 49–column 83 line 12 |
| Preservatives in developing solutions | column 88 line 19–column 89 line 22 | | |

As the cyan, magenta and yellow couplers for use in the present invention, the couplers described in Japanese Patent Laid-Open No. 215,272/1987, page 91, right upper column, line 4 to page 121, left upper column, line 6, Japanese Patent Laid-Open No. 33,144/1990, page 3, right upper column, line 14 to page 18, left upper column, last line and page 30, right upper column, line 6 to page 35, right lower column, line 11, and EP 0,355,660A2, page 4 lines 15 to 27, page 5 line 30 to page 28 last line, page 45 lines 29 to 31 and page 47 line 23 to page 63 line 50 are also usable.

Further, the compounds represented by the general formulas (II) and (III) described in WO-98/33760 and the compounds represented by the general formula (D) described in Japanese Patent Laid-Open No. 221,825/1998 may be advantageously added in the present invention.

The cyan, magenta and yellow couplers are described in more detail below.

As the cyan coupler for use in the present invention, pyrrolotriazole-based couplers are preferably used, and couplers represented by the general formula (I) or (II) described in Japanese Patent Laid-Open No. 313,324/1993, couplers represented by the general formula (I) described in Japanese Patent Laid-Open No. 347,960/1994 and the couplers listed in these publications are particularly preferable.

Further, phenol-based and naphthol-based cyan couplers are also preferable. For example, the cyan couplers represented by the general formula (ADF) described in Japanese Patent Laid-Open No. 333,297/1998 are preferable.

As cyan couplers other than those described above, pyrroloazole-based cyan couplers described in European Patent EP 0,488,248 and EP 0,491,197A1, 2,5-diacylaminophenol couplers described in U.S. Pat. No. 5,888,716 and pyrazoloazole-based cyan couplers having an electron attractive group or a hydrogen bonding group at a 6-position described in U.S. Pat. Nos. 4,873,183 and 4,916,051 are preferable. Particularly, pyrazoloazole-based cyan couplers having a carbamoyl group at a 6-position described in Japanese Patent Laid-Open Nos. 171,185/1996, 311,360/1996 and 339,060/1996 are also preferable.

Further, diphenylimidazole-based cyan couplers described in Japanese Patent Laid-Open No. 33,144/1990, 3-hydroxypyridine-based cyan couplers described in European Patent EP 0,333,185A2 (particularly, a 2-equivalent coupler made from an exemplary coupler (42) by providing a chlorine leaving-group to a 4-equivalent coupler and a coupler (6) or (9) are particularly preferable among the couplers listed as examples), cyclic active methylene-based cyan couplers described in Japanese Patent Laid-Open No. 32,260/1989 (among these couplers, couplers 3, 8 and 34 are particularly preferable), pyrrolopyrazole-based cyan couplers described in European Patent EP 0,456,226A1 and pyrroloimidazole-based cyan couplers described in European Patent EP 0,484,909 can also be used.

Incidentally, among these cyan couplers, pyrroloazole-based cyan couplers represented by the general formula (I) described in Japanese Patent Laid-Open No. 282,138/1999 are particularly preferable. The descriptions in the above-mentioned patent, paragraphs [0012] to [0059] of this publication, including the exemplary cyan couplers (1) to (47), are all applicable to the present invention and preferably incorporated herein as a part hereof.

As the magenta coupler for use in the present invention, 5-pyrazolone-based magenta couplers or pyrazoloazole-based magenta couplers as described in known literatures listed in Table 1 above are used. Among these couplers, pyrazolotriazole couplers having a secondary or tertiary alkyl group directly linked to a 2-, 3- or 6-position of the pyrazolotriazole ring as described in Japanese Patent Laid-Open No. 65,245/1986, pyrazoloazole couplers containing a sulfonamide group in the molecule as described in Japanese Patent Laid-Open No. 65,246/1986, pyrazoloazole couplers having an alkoxyphenyl-sulfonamide ballast group as described in Japanese Patent Laid-Open No. 147,254/1986 and pyrazoloazole couplers having an alkoxy group or an aryloxy group at a 6-position as described in EP 226,849A and EP 294,785A are preferably used in view of a hue, an image stability and color development.

Specifically, as magenta couplers, pyrazoloazole couplers represented by the general formula (M-I) described in Japanese Patent Laid-Open No. 122,984/1996 are preferable, and the description in paragraphs [0009] to [0026] of this publication is all applicable to the present invention.

In addition, pyrazoloazole couplers having sterically hindering groups at both a 3-position and a 6-position as described in European Patent EP Nos. 854,384 and 884,640 are also preferably used.

As yellow couplers for use in the present invention, besides the compounds listed in Table 1 above, acylacetamide-type yellow couplers having a 3- to 5-membered cyclic structure in an acyl group described in European patent EP 0,447,969A1, malondianilide-type yellow couplers having a cyclic structure described in European Patent EP 0,482,552A1, pyrrole-2-yl, pyrrole-3-yl, indole-2-yl or indole-3-yl carbonylacetanilide-based couplers described in European Patent Laid-Open Nos. 953,870A1, 953,871A1, 953,872A1, 953,873A1, 953,874A1 and 953,875A1, and acylacetamide-type yellow couplers having a dioxane structure described in U.S. Pat. No. 5,118,599 are preferably used. Among these couplers, acylacetamide-type yellow couplers whose acyl group is a 1-alkylcyclopropane-l-carbonyl group or a malondianilide-type yellow coupler in which one of the anilides constitutes an indoline ring is particularly preferable. These couplers can be used either singly or in combination.

It is preferable that the couplers to be used in the present invention is impregnated with a loadable latex polymer (described, for example, in U.S. Pat. No. 4,203,716) in the presence (or in the absence) of a high-boiling point organic solvent listed in Table 1 above or is dissolved with a water-insoluble but an organic solvent-soluble polymer and thereafter the coupler is emulsified and dispersed in a hydrophilic colloid aqueous solution.

Examples of water-insoluble but organic solvent-soluble polymers include the homopolymers and copolymers described in U.S. Pat. No. 4,857,449, columns 7 to 15 and International Laid-Open WO 88/00723, pages 12 to 30. Among these polymers, methacrylate-based or acrylamide-based polymers are more preferable, and acrylamide-based polymers are particularly preferable in view of color image stability, etc.

In the present invention, conventionally known color mixing inhibitors can be used. Particularly, the color mixing inhibitors described in the patents listed below are preferable.

For example, the high-molecular weight redox compounds described in Japanese Patent Laid-Open No. 333,501/1993, phenidone-based or hydrazine-based compounds described in WO 98/33,760 and U.S. Pat. No. 4,923,787 and white couplers described in Japanese Patent Laid-Open Nos. 249,637/1993 and 282,615/1998 and German Patent No. 19,629,142A1 can be used. Further, when raising the pH value of the developing solution to accelerate development processing, the redox compounds described in German Patent No. 19,618,786A1, European Patent Nos. 839,623A1, European Patent EP 842,975A1, German Patent No. 19,806,846A1 and French Patent No. 2,760,460A 1 are preferably used.

In the present invention, it is preferable to use a compound which contains a triazine skeleton having a high molar absorption coefficient as an ultraviolet absorbing agent. For example, the compounds described in the following publications can be used. These compounds are added to a photosensitive layer and/or a non-photosensitive layer.

For example, compounds that can be used are those described in Japanese Patent Laid-Open Nos. 3,335/1971, 152,776/1980, 197,074/1993, 232,630/1993, 307,232/1993, 211,813/1994, 53,427/1996, 234,364/1996, 239,368/1996, 31,067/1997, 115,898/1998, 147,577/1998 and 182,621/1998, German Patent No. 19,739,797A, European Patent No. 711,804A and Japanese National Publication No. 501,291/1996, etc.

Although gelatin is advantageously used as a binder or protective colloid usable in the silver halide color photographic photosensitive material of the present invention, a hydrophilic colloid other than gelatin can be used either singly or in combination with gelatin. The content of heavy metals such as iron, copper, zinc or manganese, as impurities in the gelatin that is preferable for use in the present invention, is preferably 5 ppm or less, and more preferably 3 ppm or less.

Calcium content in the silver halide color photographic photosensitive material is preferably 20 mg/m$^2$ or less, more preferably 10 mg/m$^2$ or less, most preferably 5 mg/m$^2$ or less.

In the present invention, in order to inhibit the growth of fungi or bacteria in the hydrophilic colloid layer, which causes deterioration of the images, it is preferable to add various fungicides or bactericides described in Japanese Patent Laid-Open No. 271,247/1988.

Further, the pH value of the coating film of the silver halide color photographic photosensitive material is preferably 4.0 to 7.0, more preferably 4.0 to 6.5.

In the present invention, from the standpoints of improving coating stability, preventing generation of static electricity and controlling the amount of electric charge, a surfactant can be added to the silver halide color photographic photosensitive material. Examples of surfactants include an anionic surfactant, a cationic surfactant, a betaine-based surfactant and a nonionic surfactant. For example, those described in Japanese Patent Laid-Open No. 333,492/1993 may be used. As surfactants for use in the present invention, a fluorine-containing surfactant is preferable. In particular, a fluorine containing surfactant may be advantageously used.

The amount of the surfactant to be added to the silver halide color photographic photosensitive material is not particularly limited. The amount is usually $1\times10^{-5}$ to 1 g/m$^2$, preferably $1\times10^{-4}$ to $1\times10^{-1}$ g/m$^2$, more preferably $1\times10^{-3}$ to $1\times10^{-2}$ g/m$^2$.

Fluorine-containing surfactants may be used either singly or in combination with other known surfactants. Preferably, the fluorine-containing surfactants are used in combination with conventionally known other surfactants.

The silver halide color photographic photosensitive material of the present invention is used in a printing system with an ordinary negative printer, and it is also suitable for use in a scanning exposure system using a cathode ray tube (CRT). A cathode ray tube exposing device is simpler and more compact, and less expensive, compared with a device using a laser. Further, control of optical axis or color is easier with a cathode-ray tube exposing device.

The cathode ray tube for image exposure uses various luminescent materials that emit light in the desired spectral regions. For example, any one of a red, green and blue luminescent material is used singly, or alternatively, two or more of these luminescent materials are used in combination. The spectral regions are not limited to red, green and blue. A fluorescent substance which emits light in a yellow, orange, purple or infrared region may also be used. In particular, a cathode ray tube which emits white color by combined use of these luminescent materials is often used.

In the case where the silver halide color photographic photosensitive material has plural photosensitive layers each having a different spectral sensitivity distribution and the cathode tube has fluorescent substances emitting light in plural spectral regions, exposure to plural colors may be performed at the same time. In other words, image signals of plural colors may be inputted into the cathode ray tube so that the lights of these colors are emitted from the tube face. Alternatively, a method in which the image signal of each color is successively inputted into the cathode ray tube and exposure is conducted through films which each passes light of a single color but cuts other colors (surface successive exposure) may be adopted. Generally, surface successive exposure is preferable from the standpoint of improving the image qualities because a high-resolution cathode ray tube can be used in this method.

The silver halide color photographic photosensitive material of the present invention is preferably used in a digital scanning exposure system using a single-color, high-density light such as a gas laser, a light-emitting diode, a semiconductor laser or a secondary high-frequency generating (SHG) light source formed of a combination of a solid-state laser using a semiconductor laser as an exciting light source and a non-linear optical crystal. In order to make the system compact and inexpensive, it is preferable to use a semiconductor laser or a secondary high-frequency generating light source (SHG) formed of a combination of a semiconductor laser or a solid-state laser and a non-linear optical crystal. Particularly, in order to design a device, which is compact and inexpensive and has a long life and high stability, it is preferable to use a semiconductor laser. It is preferable that at least one of light sources for exposure is a semiconductor laser.

When such a scanning light source for exposure is used, the peak wavelength of spectral sensitivity of the silver halide color photographic photosensitive material of the present invention can be set as desired in accordance with the wavelength of the scanning light source to be used. In the SHG light source obtained by a combination of a solid-state laser using a semiconductor laser as an exciting light source or a semiconductor laser with a non-linear optical crystal, the oscillation wavelength of the laser can be halved, and therefore the blue light and green light can be obtained. Accordingly, the peaks of spectral sensitivity of the photosensitive material can be present in three ordinary blue, green and red regions.

If the exposure time is defined as the time required for exposing a pixel size corresponding to a pixel density of 400 dpi, the exposure time for this scanning exposure is preferably $10^{-4}$ second or less, more preferably $10^{-6}$ second or less.

Details of preferred scanning exposure systems that can be applied to the silver halide color photographic photosensitive material of the present invention are described in the publications listed in Table 1 above.

Further, for processing the silver halide color photographic photosensitive material of the present invention, processing materials and processing methods described in Japanese Patent Laid-Open No. 207,250/1990, page 26, right lower column, line 1 to page 34, right upper column, line 9 and Japanese Patent Laid-Open No.97,355/1992, page 5, left upper column, line 17 to page 18, right lower column, line 20 can preferably be employed. Further, as preservatives used in the developing solution, the compounds described in the publications listed in Table 1 above are preferably used.

The silver halide color photographic photosensitive material of the present invention is also suitably used as a photosensitive material that has compatibility with rapid processing.

A color developing time means the time period from submergence of the photosensitive material into a color-developing solution to entrance of the photosensitive material into a bleach-fixing solution of a subsequent processing step. For example, if the photosensitive material is processed by an automatic developing machine, the color developing time means the sum of the time period during which the photosensitive material is immersed in the color-developing solution (so-called an in-liquid time) and the time period during which the photosensitive material, after leaving the color developing-solution, travels in air to a bleach-fixing bath of the subsequent processing step (so-called an in-air time). Likewise, the bleach-fixing time means the time period from submergence of the photosensitive material into the bleach-fixing solution to entrance of the photosensitive material into the water-rinsing or stabilizing bath of a subsequent step. Further, the water-rinsing or stabilizing time means the time period during which the photosensitive material stays in a water-rinsing or stabilizing solution and moves to a drying step after submergence of the photosensitive material into the liquid (so-called an in-liquid time).

When the rapid processing is carried out in the present invention, the color developing time is preferably at most 60 seconds, more preferably at most 50 seconds and at least 6 seconds, most preferably at most 30 seconds and at least 6 seconds. Likewise, the bleach-fixing time is preferably at most 60 seconds, more preferably at most 50 seconds and at least 6 seconds, most preferably at most 30 seconds and at least 6 seconds. Further, the water-rinsing or stabilizing time is preferably at most 150 seconds, more preferably at most 130 seconds and at least 6 seconds.

As to methods for developing the silver halide color photographic photosensitive material of the present invention after exposure thereof, conventional wet-processes such as a method which uses a developing solution containing an alkali agent and a developing agent, a method in which a developing agent is incorporated in the photosensitive material so that development is carried out by using an activator liquid such as an alkaline solution containing no developing agent (hereinafter referred to as an "activator method"), and a thermally developing method not using a processing solution can be employed. In particular, the activator method is a preferred method because the processing solution does not contain a developing agent, control and handling of the processing solution are easy, and burden of waste water treatment is mitigated and advantages in terms of environmental protection are gained.

In the activator method, as the developing agent or the precursor thereof to be incorporated in the photosensitive material, for example, hydrazine-type compounds described in Japanese Patent Laid-Open Nos. 234,388/1996, 152,686/1997, 152,693/1997, 211,814/1997 and 160,193/1997 are preferable.

Also preferably used is a development method in which a coating amount of silver of the photosensitive material is reduced and image amplification processing (intensification processing) is conducted using hydrogen peroxide. It is particularly preferable to use this method in the activator method. More specifically, an image forming method using an activator liquid containing hydrogen peroxide as described in Japanese Patent Laid-Open Nos. 297,354/1996 and 152,695/1997 is preferably employed.

In the activator method, the photosensitive material, after being processed with the activator liquid, normally undergoes a desilverization processing. However, with an image amplification processing using a photosensitive material having a low silver content, the desilverization processing can be omitted and a simple method such as water-rinsing or stabilization can be carried out. In a method in which image information is read by a scanner or the like from the photosensitive material, a processing mode that does not require desilverization processing can be employed even when a photosensitive material such as a photographic photosensitive material having a high silver content is used.

As the activator liquid used in the activator method, the desilverizing solution (bleach/fixing solution), the processing materials for the water-rinsing solution and stabilizing solution and the processing method, conventionally known ones can be used. Those described in Research Disclosure Item 36544 (September, 1994), pp. 536–541 and Japanese Patent Laid-Open No. 234,388/1996 can preferably be employed.

When the silver halide color photographic photosensitive material of the present invention undergoes printer exposure, it is preferable to use a band-stop filter described in U.S. Pat. No. 4,880,726. The use of this filter eliminates color mixing due to light, and color reproducibility is remarkably increased.

In the present invention, copying regulation may be performed by subjecting the photosensitive material to pre-exposing using yellow microdot patterns before image information is supplied, as described in European Patent Nos. 0,789,270A1 and 0,789,480A1.

The silver halide color photographic photosensitive material of the present invention can preferably be used in combination with the exposure systems and developing systems described in the following conventionally known literatures.

- Automatic printing system and developing system described in Japanese Patent Laid-Open No. 333,253/1998;
- Equipment for transferring a photosensitive material described in Japanese Patent Laid-Open No. 10,206/2000;
- Recording system including an image-reading device described in Japanese Patent Laid-Open No. 215,312/1999;
- Exposing system comprising a color-image recording method described in Japanese Patent Laid-Open No. 88,619/1999 and Japanese Patent Laid-Open No. 202,950/1998;
- Digital photoprint system including a remote diagnosis method described in Japanese Patent Laid-Open No. 210,206/1998; and
- Photoprint system including the image-recording device described in Japanese Patent Laid-Open No. 159,187/1998.

EXAMPLES

The present invention is illustrated specifically below by referring to Examples. However, the present invention is not limited to these Examples.

Example 1

Emulsions used for manufacturing a silver halide color photographic photosensitive material of the present invention and additional emulsions to be compared therewith were prepared as follows.

Preparation of Emulsion 101

A 10% NaCl solution (46.3 ml) was added to 1.06 l of deionized distilled water containing 5.7% by mass of deionized gelatin, followed by addition of 46.4 ml of $H_2SO_4$ (1N) and further addition of 0.012 g of a compound A. The solution temperature was then adjusted to 50° C., and 0.1 mol of silver nitrate and 0.1 mol of NaCl were immediately added to a reaction vessel with vigorous stirring over a period of 10 minutes so as to form a core portion of silver halide grains.

Subsequently, 1.5 mol of silver nitrate and an NaCl solution were added over a period of 60 minutes by a flow rate accelerating method such that the final adding rate was 4 times as high as the initial adding rate so as to form a first shell portion. Then, 0.2 mol % of silver nitrate and an NaCl solution were added at a fixed adding rate over a period of 6 minutes so as to form a second shell portion. At this time, illumination-conversion compounds- 1, -2 and -3 were added to the NaCl solution in amounts of $1\times10^{-8}$ mol, $5\times10^{-7}$ mol and $2\times10^{-6}$ mol based on total mol of silver, respectively, to be doped into the silver halide grains.

Further, to the resultant mixture were added 0.2 mol of silver nitrate, 0.16 mol of NaCl and 0.04 mol of a KBr solution over a period of 6 minutes so as to form a third shell portion. At this time, $K_4Ru(CN)_6$ in an amount corresponding to $1\times10^{-5}$ mol based on total mol of silver was dissolved in the halogen aqueous solution in order to be added to the silver halide grains.

Moreover, during a growing step of the grains at this final stage, a KI aqueous solution having a concentration corresponding to 0.003 mol based on total mol of silver was added to the reaction vessel for 1 minute. The addition was started when 93% of formation of total grains was completed, and continued until 95% of formation thereof was completed.

Thereafter, a compound B as a precipitating agent was added at 40° C., and pH was adjusted to approximately 3.5, followed by desalting and water-rinsing.

To the emulsion after desalting and water-rinsing were added deionized gelatin, an NaCl aqueous solution and an NaOH aqueous solution. The temperature was elevated to 50° C., and pAg was adjusted to 7.6 and pH adjusted to 5.6.

As a result, a silver halide emulsion 101 was produced which contained cubic silver halide grains having a halogen composition of 97.8 mol % of silver chloride, 2 mol % of silver bromide and 0.2 mol % of silver iodide, and having an average side length of 0.41 $\mu$m and a side length variation coefficient of 8%.

The silver halide emulsion 101 thus produced was maintained at 50° C., to which were added $3\times10^{-4}$ mol of a spectral sensitizing dye-1 and $3\times10^{-5}$ mol of a spectral sensitizing dye-2, respectively, per mol of Ag, followed by addition of $1\times10^{-5}$ mol of thiosulfonic acid compound-1 per mol of Ag.

Then, $1\times10^{-5}$ mol of sodium thiosulfate and $2\times10^{-5}$ mol of a gold sensitizer-1, respectively, per mol of Ag were added. Immediately after the addition, the temperature was elevated to 60° C. in order to carry out ripening for 40 minutes. Thereafter, the temperature was lowered to 50° C.

Immediately after the temperature was lowered, a mercapto compound-1 and a mercapto compound-2 were added in respective amounts of $6\times10^{-4}$ mol per mol of Ag. And after ripening for 10 minutes, a KBr aqueous solution to constitute 0.008 mol based on silver was added. And after ripening for 10 minutes, the temperature was lowered, and the resulting product was stored.

Preparation of Silver Halide Emulsions 102 to 115

Silver halide emulsions 102, 103 and 107 to 112 according to the present invention and additional silver halide emulsions 104 to 106 and 113 to 115 to be compared with the emulsions according to the present invention were prepared in the same manner as conducted for a silver halide emulsion 101 except that the halogen composition of the third shell portion and the amounts of illumination-conversion compounds-1, -2 and -3 doped into the second shell portion during a step for forming the grains were changed to those shown in Table 2, and processed in the same manner as conducted for a silver halide emulsion 101.

Measurement and Evaluation of Silver Halide Emulsions

Silver halide emulsions 101 to 115 were evaluated for the ionic conductivity from dielectric loss properties of the samples of the emulsions that had been shaped to have a thickness of about 100 μm in a dry film state. As a dielectric loss measuring device, a device disclosed in the *Journal of the Society of Photographic Science and Technology of Japan*, Vol. 44, 81 (1981) was used.

The electron residence time of the illumination-conversion dopants was measured by means of sensitometry using the following coated samples according to the description on page 297 of "*Kaitei Shashin Kogaku no Kiso: Gin-en Shashin hen* (Fundamentals of Photographic Science and Engineering (Revised): Silver Photography", edited by the Society of Photographic Science and Technology. The sensitometry method will be described later. The results are shown in Table 2 below.

In Table 2, ratios of the highest ionic conductivity to the lowest ionic conductivity were obtained from the ion conductivity of the emulsions by setting the value of the ion conductivity of an emulsion 113, which was composed of pure silver chloride and from which the illumination-conversion compound had been removed, as the lowest ionic conductivity based on a silver chloride layer.

Compound A

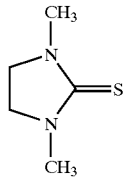

Compound B

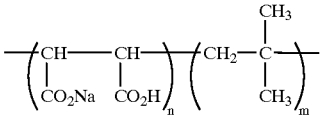

n and m are integers

Spectral sensitizing dye-1

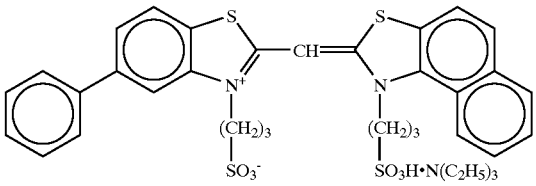

-continued

Spectral sensitizing dye-2

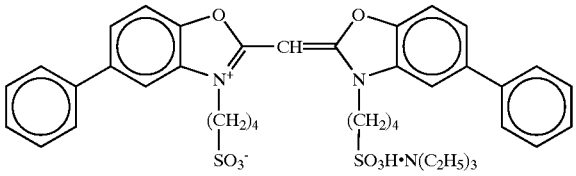

Thiosulfonic acid compound-1

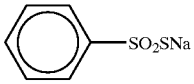

Gold sensitizer-1

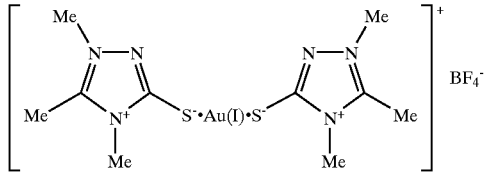

Mercapto compound-1

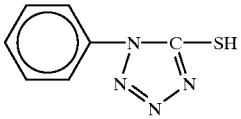

Mercapto compound-2

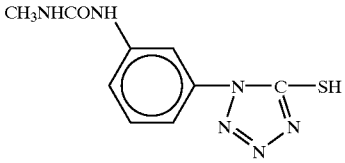

Illumination-conversion compound-1

$K_4IrCl_6$

Illumination-conversion compound-2

$K_4Ir(H_2O)Cl_5$

Illumination-conversion compound-3

$K_4Ir(thiazole)Cl_5$

TABLE 2

| Silver halide emulsion | Halogen composition of a third shell portion | Amount of illumination-conversion compound doped into a second shell portion (mol per mol of Ag) Illumination-conversion compound-1 | Illumination-conversion compound-2 | Illumination-conversion compound-3 | Ratio of maximum ionic conductivity/ minimum ionic conductivity | Estimated electron residence time at the Ir center (sec) | Remarks |
|---|---|---|---|---|---|---|---|
| 101 | $AgCl_{77}Br_{20}I_3$ | $1 \times 10^{-8}$ | $5 \times 10^{-7}$ | $2 \times 10^{-6}$ | 200 | 1/20 | P.I. |
| 102 | $AgCl_{77}Br_{20}I_3$ | $3 \times 10^{-8}$ | — | — | 200 | 5 | P.I. |
| 103 | $AgCl_{77}Br_{20}I_3$ | — | $1 \times 10^{-6}$ | — | 200 | 1/2000 | P.I. |
| 104 | $AgCl_{80}Br_{20}$ | — | — | $3 \times 10^{-6}$ | 5 | 1/200 | Comp. Ex. |

TABLE 2-continued

| Silver halide emulsion | Halogen composition of a third shell portion | Amount of illumination-conversion compound doped into a second shell portion (mol per mol of Ag) Illumination-conversion compound-1 | Illumination-conversion compound-2 | Illumination-conversion compound-3 | Ratio of maximum ionic conductivity/minimum ionic conductivity | Estimated electron residence time at the Ir center (sec) | Remarks |
|---|---|---|---|---|---|---|---|
| 105 | $AgCl_{80}Br_{20}$ | — | $1 \times 10^{-6}$ | — | 5 | 1/2000 | Comp. Ex. |
| 106 | $AgCl_{80}Br_{20}$ | $3 \times 10^{-8}$ | — | — | 5 | 5 | Comp. Ex. |
| 107 | $AgCl_{97}I_3$ | $3 \times 10^{-8}$ | — | — | 300 | 10 | P.I. |
| 108 | $AgCl_{97}I_3$ | — | $1 \times 10^{-6}$ | — | 300 | 1/500 | P.I. |
| 109 | $AgCl_{97}I_3$ | — | — | $3 \times 10^{-6}$ | 300 | 1/50 | P.I. |
| 110 | $AgCl_{89}Br_9I_2$ | $3 \times 10^{-8}$ | — | — | 120 | 10 | P.I. |
| 111 | $AgCl_{89}Br_9I_2$ | — | $5 \times 10^{-7}$ | $2 \times 10^{-6}$ | 120 | 1/100 | P.I. |
| 112 | $AgCl_{89}Br_9I_2$ | — | $1 \times 10^{-6}$ | — | 120 | 1/1000 | P.I. |
| 113 | AgCl | — | $5 \times 10^{-7}$ | $2 \times 10^{-7}$ | 1 | 1/100 | Comp. Ex. |
| 114 | AgCl | — | — | $3 \times 10^{-7}$ | 1 | 1/50 | Comp. Ex. |
| 115 | AgCl | — | $1 \times 10^{-6}$ | — | 1 | 1/500 | Comp. Ex. |

Note P.I.: samples according to the present invention; Comp. Ex.: samples produced in Comparative Example Production of a Silver Halide Color Photographic Photosensitive Material A support was a sheet of paper whose both sides were covered with a polyethylene resin. The support surface underwent a corona discharge treatment and thereafter was provided with a gelatin subbing layer containing sodium dodecylbenzenesulfonate. Then, the first to the seventh photographic layers were successively formed thereon in order to produce samples 1 to 15 (samples according to the present invention: 1 to 3 and 7 to 12; and samples to be compared therewith: 4 to 6 and 13 to 15) of silver halide photosensitive materials for color photography each having the following layer construction. Coating liquids for the respective photographic constituent layers were prepared in the following manner.

Preparation of a Coating Liquid for Forming the First Layer 57 g of a yellow coupler (ExY), 7 g of a color image stabilizer (Cpd-1), 4 g of a color image stabilizer (Cpd-2), 7 g of a color image stabilizer (Cpd-3) and 2 g of a color stabilizer (Cpd-8) were dissolved in 21 g of a solvent (Solv-1) and 80 ml of ethyl acetate. The resulting solution was emulsified and dispersed in 220 g of a 23.5% by mass gelatin aqueous solution containing 4 g of sodium dodecylbenzenesulfonate using a high-speed stirring machine for emulsification (a dissolver). After that, water was added to the product to make 900 g of an emulsified dispersion A.

Meanwhile, the emulsified dispersion A and the emulsion 101 were mixed together and dissolved to prepare a coating liquid for the first layer of the composition described later. Coating weight of the emulsion indicates a weight equivalent to weight of silver.

Coating liquids for forming the second to the seventh layers were prepared according to a method similar to that of the coating solution for the first layer. As a gelatin hardener for each layer, sodium 1-oxy-3,5-dichloro-s-triazine (H-1), (H-2) and (H-3) were used each in a total amount of 100 mg/m$^2$. Further, the following Ab-1, Ab-2, Ab-3 and Ab-4 were added to each layer in total amounts of 15.0 mg/m$^2$, 60.0 mg/m$^2$, 5.0 mg/m$^2$ and 10.0 mg/m$^2$, respectively.

(H-1) Hardener

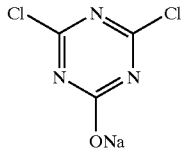

(used at 1.4% by mass of the gelatin)

(H-2) Hardener

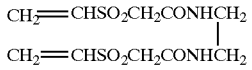

(H-3) Hardener

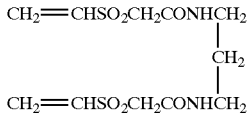

(Ab-1) Preservative

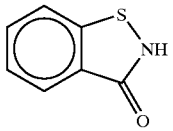

(Ab-2) Preservative

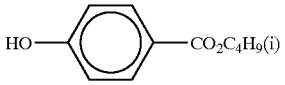

(Ab-3) Preservative

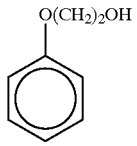

-continued (Ab-4) Preservative

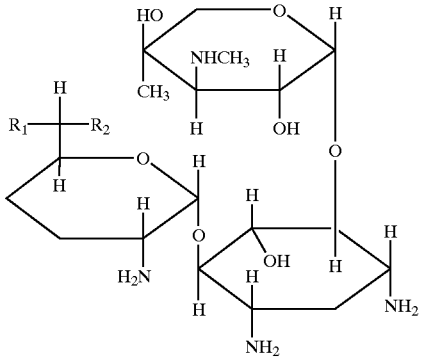

| | $R_1$ | $R_2$ |
|---|---|---|
| a | —$CH_3$ | —$NHCH_3$ |
| b | —$CH_3$ | —$NH_2$ |
| c | —H | —$NHCH_3$ |
| d | —H | —$NH_2$ |

1:1:1:1 (by molar ratio) mixture of a, b, c and d

To the silver chlorobromide emulsions in the green- and red-sensitive emulsion layers, the following spectral sensitizing dyes were added in place of the sensitizing dyes used for the emulsions 101 to 115.

Green-sensitive Emulsion Layer (Sensitizing Dye D)

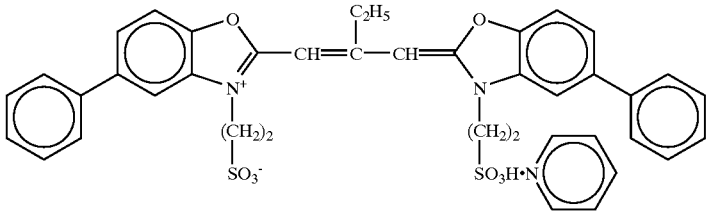

(Sensitizing dye E)

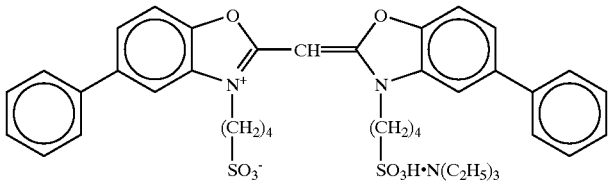

(Sensitizing dye F)

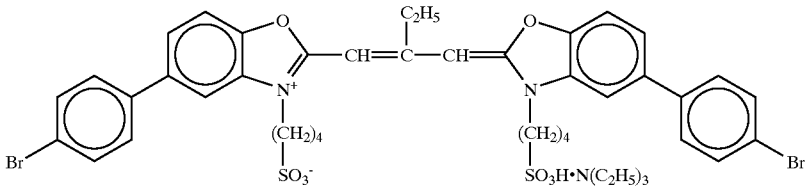

To each emulsion were added a sensitizing dye D in an amount of $3.4\times10^{-4}$ mol per mol of silver halide, a sensitizing dye E in an amount of $5.6\times10^{-5}$ mol per mol of silver halide, and a sensitizing dye F in an amount of $5.0\times10^{-4}$ mol per mol of silver halide, respectively.

Red-sensitive Emulsion Layer (Red-sensitive emulsion layer)

(Sensitizing dye G)

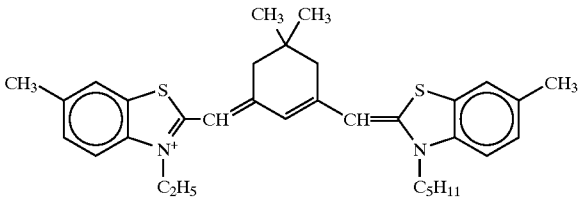

(Sensitizing dye H)

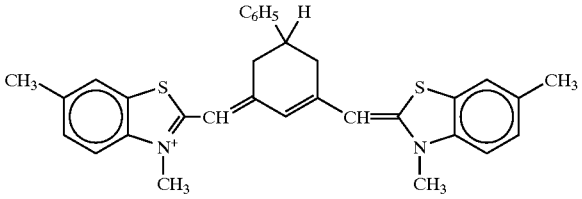

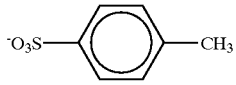

Sensitizing dyes G and H were added in respective amounts of $9.0\times10^{-5}$ mol per mol of silver halide, in place of the sensitizing dyes added for the emulsions 101 to 115.

Further, the following compound I was added to the red-sensitive emulsion layer in an amount of $3.0\times10^{-3}$ mol per mol of silver halide.

(Compound I)

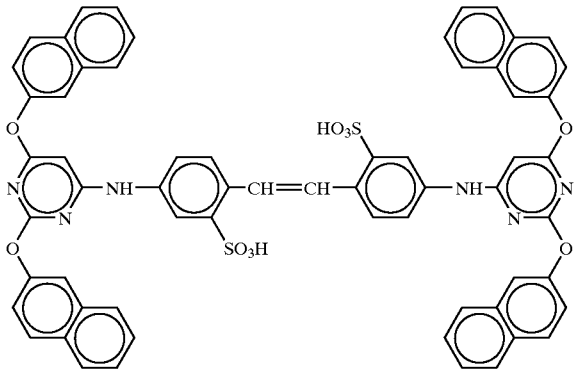

Compound I was also added to the second, fourth, sixth and seventh layers in amounts of 0.2 mg/m$^2$, 0.2 mg/m$^2$, 0.6 mg/m$^2$ and 0.1 mg/m$^2$, respectively.

Further, 4-hydroxy-6-methyl-1,3,3a,7-tetrazaindene was added to the blue-sensitive emulsion layer and the green-sensitive emulsion layer in amounts of $1\times10^{-4}$ mol and $2\times10^{-4}$ mol per mol of silver halide, respectively.

A latex of methacrylic acid/butyl acrylate copolymer (a monomer ratio by mass of 1:1, average molecular weight 200,000 to 400,000) was added to the red-sensitive emulsion layer in an amount of 0.05 g/m$^2$.

Disodium catechol-3,5-disulfonate was added to the second layer, the fourth layer and the sixth layer in amounts of 6 mg/m$^2$, 6 mg/m$^2$ and 18 mg/m$^2$, respectively.

In addition, the following dyes were added so as to prevent irradiation (numerals in parentheses indicate coating weights).

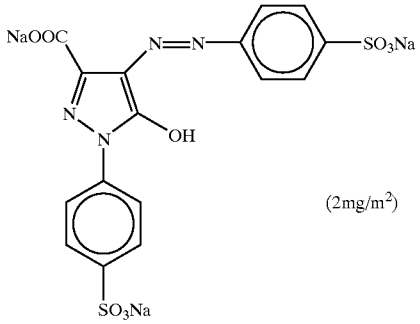

(2mg/m$^2$)

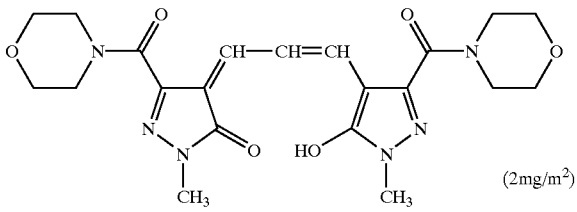

(2mg/m$^2$)

-continued

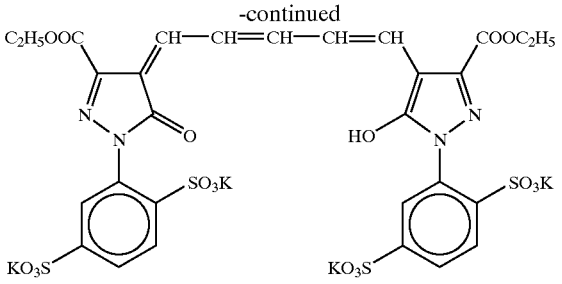

(3mg/m$^2$)

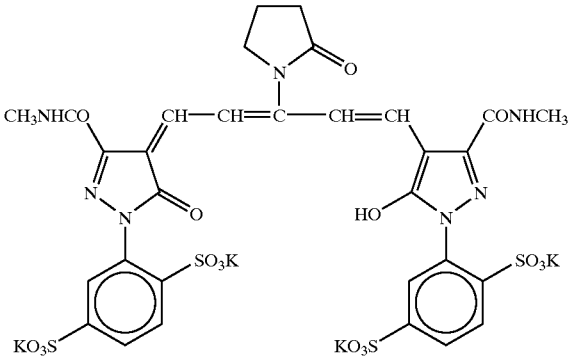

(7mg/m$^2$)

Layer Construction

The construction of each layer is given below. Each numeral indicates a coating weight (g/m$^2$). The amount of the silver halide emulsion indicates the coating weight equivalent to weight of silver.

Support

Paper laminated with a polyethylene resin [the polyethylene resin on the first layer side contained white pigments ($TiO_2$ content: 16% by mass, ZnO content: 4% by mass), a fluorescent brightener (4,4'-bis(5-methylbenzoxazolyl) stilbene: 0.03% by mass), and a bluing dye (ultramarine blue)]

| | |
|---|---|
| First layer (blue-sensitive emulsion layer) | |
| Emulsions 101 to 115 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color mixing preventive layer) | |
| Gelatin | 0.99 |
| Color mixing inhibitor (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green-sensitive emulsion layer) | |
| Emulsions 101 to 115 in which sensitizing dyes were changed | 0.14 |
| Gelatin | 1.36 |
| Magenta coupler (ExM) | 0.15 |
| Ultraviolet absorbing agent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |

-continued

| | |
|---|---|
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color mixing preventive layer) | |
| Gelatin | 0.71 |
| Color mixing inhibitor (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red-sensitive emulsion layer) | |
| Emulsions 101 to 115 in which sensitizing dyes were changed | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth layer (ultraviolet absorbing layer) | |
| Gelatin | 0.46 |
| Ultraviolet absorbing agent (UV-B) | 0.45 |
| Compound (S1-4) | 0.0015 |
| Solvent (Solv-7) | 0.25 |
| Seventh layer (protective layer) | |
| Gelatin | 1.00 |
| Acryl-modified copolymer of polyvinyl alcohol (degree of modification: 17%) | 0.04 |
| Liquid paraffin | 0.02 |
| Surfactant (Cpd-13) | 0.01 |

(ExY) Yellow coupler
A 70:30 (molar ratio) mixture of

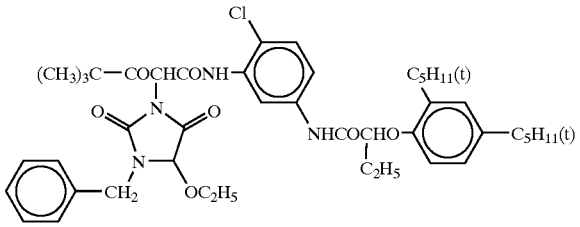

and

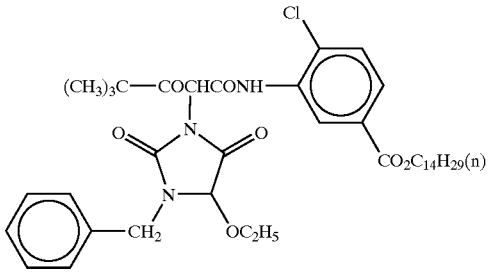

-continued (ExM) Magenta coupler
A 40:40:20 (molar ratio) mixture of

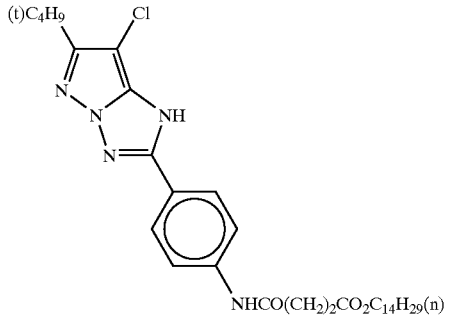

and

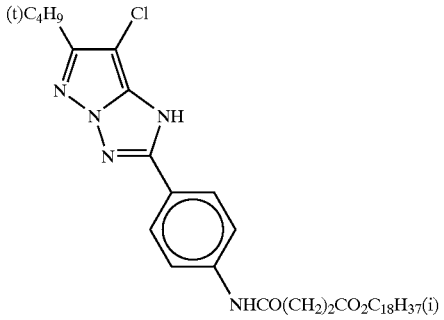

and

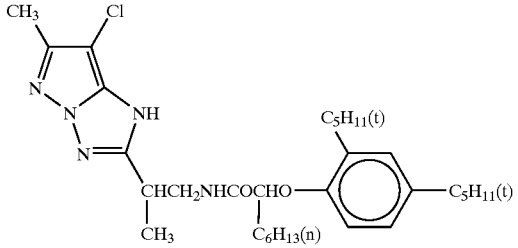

(ExC-2) Cyan coupler

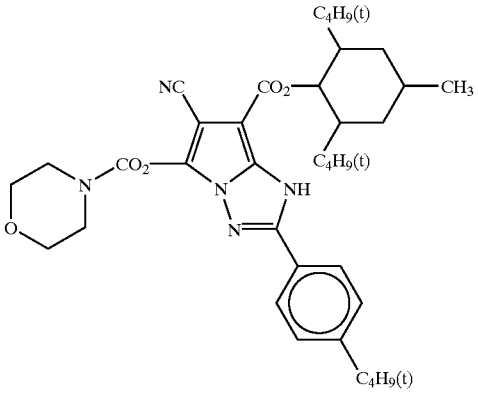

(ExC-3) Cyan coupler
A 50:25:25 (molar ratio) mixture of

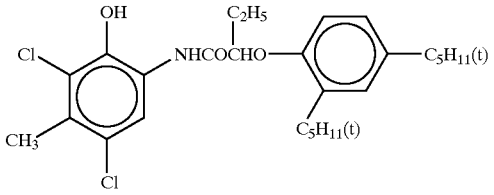

and

-continued

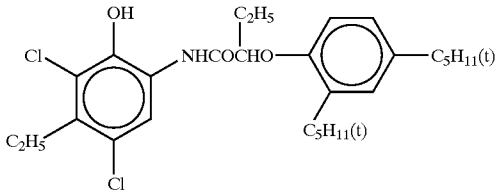

and

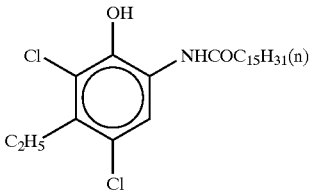

(Cpd-1) Color image stabilizer

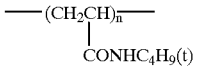

number average molecular weight 60,000

(Cpd-2) Color image stabilizer

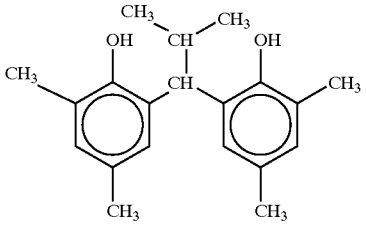

(Cpd-3) Color image stabilizer

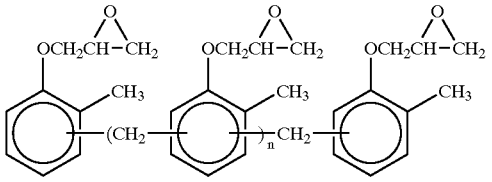

n = 7 to 8 (average)

(Cpd-4) Color mixing preventative agent

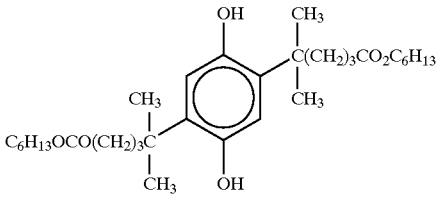

(Cpd-5) Color image stabilizer

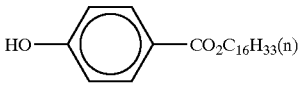

(Cpd-6) Color image stabilizer

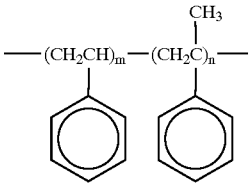

number average molecular weight: 600 m/n = 10/90

-continued (Cpd-7) Color image stabilizer

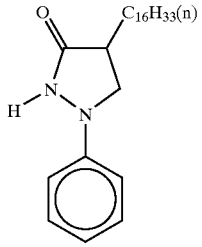

(Cpd-8) Color image stabilizer

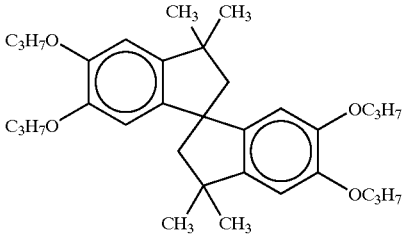

(Cpd-9) Color image stabilizer

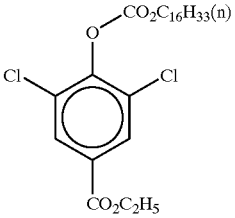

(Cpd-10) Color image stabilizer

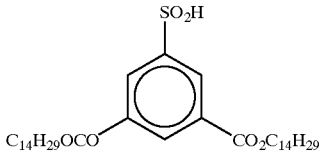

(Cpd-11)

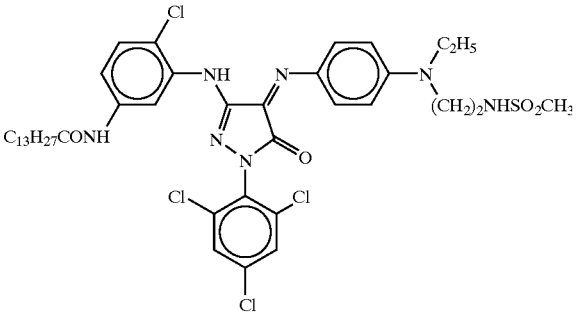

(Cpd-13) Surfactant

A 7:3 (molar ratio) mixture of

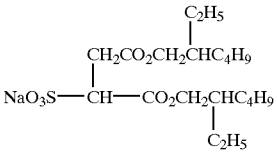

and

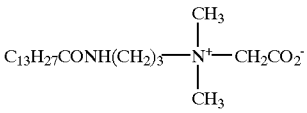

-continued (Cpd-14)

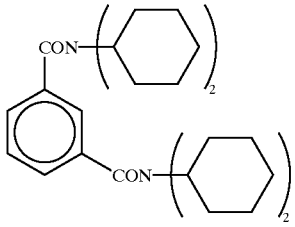

(Cpd-15)

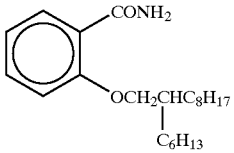

(Cpd-16)

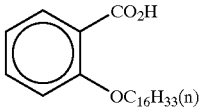

(Cpd-17)

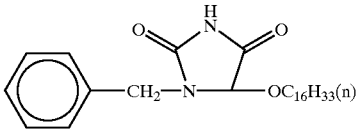

(Cpd-18)

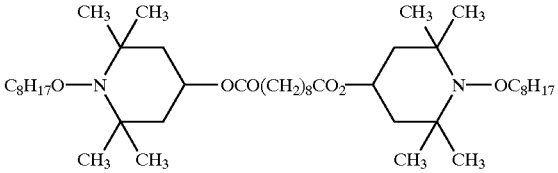

(Cpd-19) Color mixing preventive agent

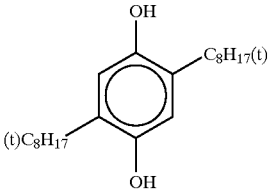

(UV-1) Ultraviolet absorbing agent

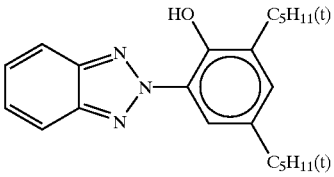

(UV-2) Ultraviolet absorbing agent

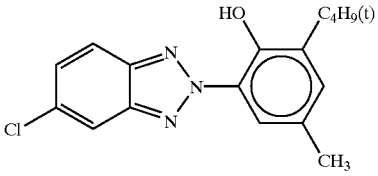

-continued (UV-3) Ultraviolet absorbing agent

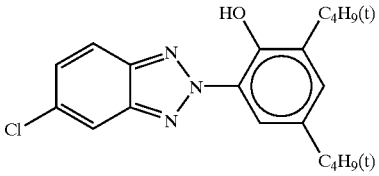

(UV-4) Ultraviolet absorbing agent

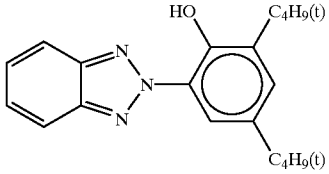

(UV-5) Ultraviolet absorbing agent

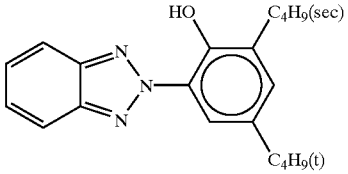

(UV-6) Ultraviolet absorbing agent

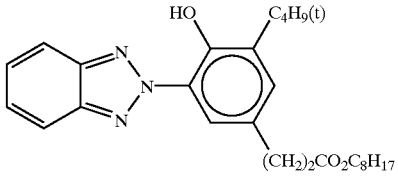

(UV-7) Ultraviolet absorbing agent

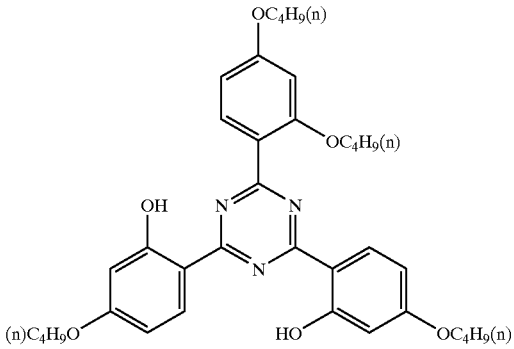

(UV-8) Ultraviolet absorbing agent
A 50:50 (mass ratio) mixture of

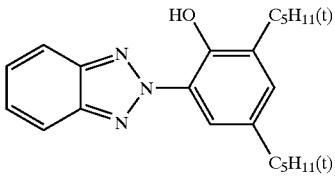

and

-continued

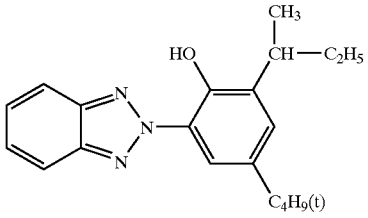

UV-A:
4/2/2/3 (mass ratio) mixture of UV-1, UV-2, UV-3 and UV-4

UV-B:
9/3/3/4/5/3 (mass ratio) mixture of UV-1, UV-2, UV-3, UV-4, UV-5 and UV-6

UV-C:
1/1/1/2 (mass ratio) mixture of UV-2, UV-3, UV-6 and UV-7

UV-A′:
4/2/2/3 (mass ratio) mixture of UV-1, UV-2, UV-3 and UV-8

UV-B′:
9/3/3/4/5/3 (mass ratio) mixture of UV-1, UV-2, UV-3, UV-8, UV-5 and UV-6

(Solv-1)

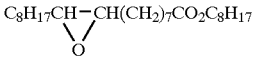

(Solv-2)
A 1:1 (mass ratio) mixture of

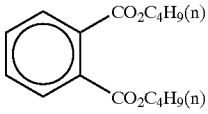

and

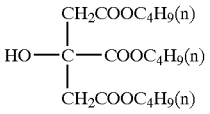

(Solv-3)

(Solv-4)

(Solv-5)

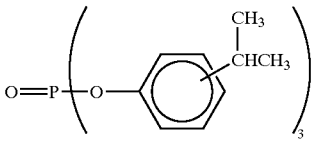

(Solv-7)

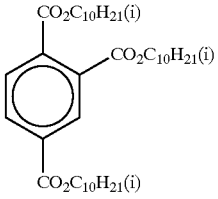

(Solv-8)

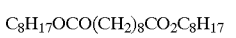

-continued (S1-4)

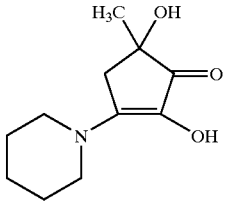

The samples 1 to 15 obtained above underwent the following experiments for sensitometry and were examined for the pressure sensitivity at wet condition during developing process.

Experiment 1 Sensitometry

The samples were each subjected to gradation exposure for sensitometry, by using a sensitometer for high-intensity exposure (model HIE manufactured by Yamashita Denso Co., Ltd.) and a standard luminance sensitometer (tungsten light source). The samples were exposed for 10 seconds, 1 second, 1/10 second, 1/100 second, 1/1,000 second, 1/10,000 second, 1/100,000 second and 1/1,000,000 second for each of a blue filter, a red filter and a green filter. After exposure, the samples were subjected to the following color development processing A.

Processing steps are indicated below.

Processing A

Each of the samples was formed into a rolled web having a width of 127 mm and subjected to image-wise exposure using MINI-LABO PRINTER PROCESSOR PP1258AR, manufactured by Fuji Photo Film Co., Ltd. After that, continuous processing (running test) of the samples was carried out according to the following processing steps until a replenished amount of a replenisher solution to the color developing tank reached double the tank capacity. The processing using this running liquid was designated as processing A.

| Processing step | Temperature | Duration | Replenished amount* |
|---|---|---|---|
| Color development | 38.5° C. | 45 sec | 45 ml |
| Bleach-fixing | 38.0° C. | 45 sec | 35 ml |
| Rinsing (1) | 38.0° C. | 20 sec | — |
| Rinsing (2) | 38.0° C. | 20 sec | — |
| Rinsing (3)** | 38.0° C. | 20 sec | — |
| Rinsing (4)** | 38.0° C. | 30 sec | 121 ml |

*Replenished amount per 1 $m^2$ of photosensitive material
**The rinsing step (3) used a rinse cleaning system RC50D manufactured by Fuji Photo Film Co., Ltd. The rinsing liquid was drawn from the rinsing step (3) by a pump to a reverse osmosis film module (RC50D). Permeated water thus obtained was fed to the rinsing step (4), and concentrated water was returned to the rinsing step (3). The pump pressure was adjusted so that the amount of permeated water to the reverse osmosis module was maintained at 50 to 300 ml/min, and the circulation was carried out for 10 hours per day at a controlled temperature. (In the rinsing, a counter-current flow from tank (1) to (4) was employed).

The compositions of the processing solutions were as follows.

| | [Tank solution] | [Replenisher solution] |
|---|---|---|
| [Color developing solution] | | |
| Water | 800 ml | 800 ml |
| Dimethylpolysiloxane-based surfactant (SILICONE KF351A, manufactured by Shin-etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightener (HACKOL FWA-SF, manufactured by Showa Kagaku Co., Ltd.) | 2.5 g | 5.0 g |
| Sodium sulfite | 0.1 g | 0.1 g |
| Disodium-N,N-bis(sulfonateethyl)hydroxylamine | 8.5 g | 11.1 g |
| N-ethyl-N-(β-methanesulfonamidoethyl)-3–methyl-4-amino-4-aminoaniline · 3/2 sulfate · monohydrate | 5.0 g | 15.7 g |
| Potassium carbonate | 26.3 g | 26.3 g |
| Water to make | 1,000 ml | 1,000 ml |
| pH (25° C., controlled by potassium hydroxide and sulfuric acid) | 10.15 | 12.50 |
| [Bleach-fixing solution] | | |
| Water | 700 ml | 600 ml |
| Iron (III) ammonium ethylenediaminetetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfate | 16.0 g | 32.0 g |
| Ammonium bisulfite | 23.1 g | 46.2 g |
| Water to make | 1,000 ml | 1,000 ml |
| pH (25° C., controlled by acetic acid and ammonia) | 6.0 | 6.0 |
| [Rinsing solution] | | |
| Sodium chloroisocyanurate | 0.02 g | 0.02 g |
| Deionized water (conductivity: 5 μS/cm or less) | 1,000 ml | 1,000 ml |
| pH | 6.5 | 6.5 |

The samples after processing were measured for the color density in order to determine reciprocity properties. From the obtained results, the average residence time of the electrons captured by the dopants was calculated for respective emulsions. Since sensitometry varied depending on the kind of filters used at exposure, a mean value of the average residence time measured at exposures by using each of the filters was obtained. The results are shown in Table 3 below.

Experiment 2 Pressure Sensitivity at Wet Condition

In order to determine pressure-induced sensitization properties of the photosensitive materials, a remodeled scratch tester for the submerged photosensitive materials manufactured by Heydon Co., Ltd. was used. As conducted for sensitometry, the photosensitive materials that had been exposed for $10^{-4}$ second was immersed, 10 seconds after exposure, for 15 seconds in a color developing solution maintained at 37° C. A load of 100 g was burdened on a stainless steel needle having a tip diameter of 0.8 mm, while immersing, and the surface of the photosensitive material was scratched at a linear velocity of 2.5 cm/sec. Then, immersing was continued for the remaining period of time so that the total color developing time reached 45 seconds. Incidentally, in the color developing bath, the developing progress was adjusted by bubbling nitrogen gas to achieve the same sensitivity and the same gradation as obtained in the sensitometry experiment.

After the development, the photosensitive materials were processed with the same bleach-fixing solution as used in Experiment 1, followed by water-rinsing and drying.

At optical density (0.7) of cyan, magenta and yellow by color separation exposure of the photosensitive materials after the processing, an increase in the density owing to scratching was evaluated to find a mean value. The results of pressure-induced sensitization properties are shown in Table 3 below.

TABLE 3

| Silver halide color material photographic photosensitive (the emulsion used) | Estimated electron residence time at the Ir center (sec) | Pressure-induced sensitization properties (increase in the density by scratching) | Remarks |
|---|---|---|---|
| 1 (101) | 1/20 | 0.02 | P.I. |
| 2 (102) | 5 | 0.03 | P.I. |
| 3 (103) | 1/2000 | 0.00 | P.I. |
| 4 (104) | 1/200 | 0.06 | Comp. Ex. |
| 5 (105) | 1/2000 | 0.07 | Comp. Ex. |
| 6 (106) | 5 | 0.06 | Comp. Ex. |
| 7 (107) | 10 | 0.02 | P.I. |
| 8 (108) | 1/500 | 0.00 | P.I. |
| 9 (109) | 1/50 | 0.02 | P.I. |
| 10 (110) | 10 | 0.03 | P.I. |
| 11 (111) | 1/100 | 0.02 | P.I. |
| 12 (112) | 1/1000 | 0.02 | P.I. |
| 13 (113) | 1/100 | 0.08 | Comp. Ex. |
| 14 (114) | 1/50 | 0.08 | Comp. Ex. |
| 15 (115) | 1/500 | 0.08 | Comp. Ex. |

Note
P.I.: samples according to the present invention
Comp. Ex.: samples produced in Comparative Example As is clear from the results shown in Table 3 above, it was confirmed that the silver halide color photographic photosensitive materials according to the present invention showed a small density increase due to scratching and exhibited excellent pressure resistance.

Example 2

Additional emulsions were prepared in the same manner as emulsions 101 to 115, except that after adding the spectral sensitizing dyes and thiosulfonate compound and before adding sodium thiosulfate and a gold sensitizer, an emulsion composed of fine grains into which iridium hexachloride had been doped, having an average grain diameter of 0.05 μm and comprising 90 mol % of silver bromide and 10 mol % of silver chloride was added and subjected to ripening for 15 minutes, followed by the same processings as conducted for emulsions 101 to 115. It was confirmed that, among these additional emulsions, the emulsions which satisfied the requirements of the present invention exhibited the same excellent effects.

In the foregoing processes, iridium hexachloride was doped in an amount of $1\times10^{-7}$ mol per mol of Ag.

Example 3

The silver halide color photographic photosensitive materials as produced in Example 1 were manufactured in large amounts and used in DIGITAL PRINT SYSTEM FRONTIER 350, manufactured by Fuji Photo Film Co., Ltd., in 10 $m^2$ per day for 3 months. It was confirmed that the silver halide color photographic photosensitive materials according to the present invention were highly sensitive, and had no pressure-induced sensitization streak when processed.

Meanwhile, the pressure-induced sensitization streaks were observed in all the silver halide color photographic photosensitive materials which had been produced for comparison, exhibiting poor results in image-quality and uneveness of printing.

Example 4

Samples A1 to A15 in which the layer construction was changed to the following layer construction so that the layer thickness would be reduced and silver halide emulsions 101 to 115 used in Example 1 were employed in the same combinations as conducted in Example 1 were manufactured. The samples A1 to A15 were subjected to the same experiment as conducted in Example 1.

The layer construction for a sample A1 is given below. The silver halide emulsions used in the respective photosensitive layers are the same as those contained in the corresponding photosensitive layers used in Example 1.

The same results were produced as those obtained in Example 1. Even when those samples having a reduced layer thickness were subjected to rapid processing, it was revealed that all of the samples prepared by using the silver halide emulsions of the present invention exerted excellent effects.

| Preparation of a sample A1 | |
|---|---|
| First layer (blue-sensitive emulsion layer) | |
| Emulsion of Example 1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color mixing preventive layer) | |
| Gelatin | 0.60 |
| Color mixing inhibitor (Cpd-19) | 0.09 |
| Color image stabilizer (Cpd-5) | 0.007 |
| Color image stabilizer (Cpd-7) | 0.007 |
| Ultraviolet absorbing agent (UV-C) | 0.05 |
| Solvent (Solv-5) | 0.11 |
| Third layer (green-sensitive emulsion layer) | |
| Emulsion of Example 1 | 0.14 |
| Gelatin | 0.73 |
| Magenta coupler (ExM) | 0.15 |
| Ultraviolet absorbing agent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth layer (color mixing preventive layer) | |
| Gelatin | 0.48 |
| Color mixing inhibitor (Cpd-4) | 0.07 |
| Color image stabilizer (Cpd-5) | 0.006 |
| Color image stabilizer (Cpd-7) | 0.006 |
| Ultraviolet absorbing agent (UV-C) | 0.04 |
| Solvent (Solv-5) | 0.09 |
| Fifth layer (red-sensitive emulsion layer) | |
| Emulsion of Example 1 | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |

-continued

| Preparation of a sample A1 | |
|---|---|
| Color image stabilizer (Cpd-15) | 0.19 |
| Color image stabilizer (Cpd-18) | 0.04 |
| Ultraviolet absorbing agent (UV-7) | 0.02 |
| Solvent (Solv-5) | 0.09 |
| Sixth layer (ultraviolet absorbing layer) | |
| Gelatin | 0.32 |
| Ultraviolet absorbing agent (UV-C) | 0.42 |
| Solvent (Solv-7) | 0.08 |
| Seventh layer (protecting layer) | |
| Gelatin | 0.70 |
| Acryl-modified copolymer of polyvinyl alcohol (degree of modification: 17%) | 0.04 |
| Liquid paraffin | 0.01 |
| Surfactant (Cpd-13) | 0.01 |
| Polydimethylsiloxane | 0.01 |
| Silicon dioxide | 0.003 |

Each of the samples manufactured above underwent exposure in the same way as in Experiments 1 and 2 of Example 1. The samples were processed for color development according to the following processing B, which is ultra-rapid processing.

Processing B

Each of the samples was formed into a rolled web having a width of 127 mm. After image-wise exposure, continuous processing (running test) of the samples was carried out according to the following processing steps until a replenished amount of a replenisher solution to the color developing tank reached double the tank capacity. The processing using this running liquid was designated as processing B. The processing was conducted using MINI-LABO PRINTER PROCESSOR PP1258AR, manufactured by Fuji Photo Film Co., Ltd. and remodeled to increase a transferring rate so that the processing time could be shortened.

| Processing step | Temperature | Duration | Replenished amount* |
|---|---|---|---|
| Color development | 45.0° C. | 12 sec | 45 ml |
| Bleach-fixing | 40.0° C. | 12 sec | 35 ml |
| Rinsing (1) | 40.0° C. | 4 sec | — |
| Rinsing (2) | 40.0° C. | 4 sec | — |
| Rinsing (3)** | 40.0° C. | 4 sec | — |
| Rinsing (4)** | 40.0° C. | 4 sec | 121 ml |

*Replenished amount per 1 $m^2$ of photosensitive material

**The rinsing step (3) used a rinse cleaning system RC50D manufactured by Fuji Photo Film Co., Ltd. The rinsing liquid was drawn from the rinsing step (3) by a pump to a reverse osmosis film module (RC50D). Permeated water thus obtained was fed to the rinsing step (4), and concentrated water was returned to the rinsing step (3). The pump pressure was adjusted so that the amount of permeated water to the reverse osmosis module was maintained at 50 to 300 ml/min, and the circulation was carried out for 10 hours per day at a controlled temperature. (In the rinsing, a counter-current flow from tank (1) to (4) was employed).

The compositions of processing solutions were as follows.

| | [Tank solution] | [Replenisher solution] |
|---|---|---|
| [Color developing solution] | | |
| Water | 800 ml | 800 ml |
| Dimethylpolysiloxane-based surfactant (SILICONE KF351A, manufactured by Shin-etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightener (HACKOL FWA-SF, manufactured by Showa Kagaku Co., Ltd.) | 2.5 g | 5.0 g |
| Sodium sulfite | 0.1 g | 0.1 g |
| Disodium-N,N-bis(sulfonateethyl)hydroxylamine | 8.5 g | 11.1 g |
| N-ethyl-N-(β-methanesulfonamidoethyl)-3-methyl-4-amino-4-aminoaniline · 3/2 sulfate · monohydrate | 10.0 g | 22.0 g |
| Potassium carbonate | 26.3 g | 26.3 g |
| Water to make | 1,000 ml | 1,000 ml |
| pH (25° C., controlled by potassium hydroxide and sulfuric acid) | 10.15 | 12.50 |
| [Bleach-fixing solution] | | |
| Water | 700 ml | 600 ml |
| Iron (III) ammonium ethylenediaminetetraacetate | 75.0 g | 150.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfate | 16.0 g | 32.0 g |
| Ammonium metabisulfite | 23.1 g | 46.2 g |
| Water to make | 1,000 ml | 1,000 ml |
| pH (25° C., controlled by acetic acid and ammonia) | 5.5 | 5.2 |
| [Rinsing solution] | | |
| Sodium chloroisocyanurate | 0.02 g | 0.02 g |
| Deionized water (conductivity: 5 μS/cm or less) | 1,000 ml | 1,000 ml |
| pH | 6.0 | 6.0 |

Example 5

By using respective photosensitive materials manufactured in Example 1, images were formed by means of laser scanning exposure.

The laser light sources employed were: a 473 nm laser from SHG crystals of $LiNbO_3$ having an inverted domain structure which converted the wavelength of a YAG solid-state laser (oscillation wavelength: 946 nm) using a GaAlAs semiconductor laser (oscillation wavelength: 808.5 nm) as an excitation light source; a 532 nm laser from SHG crystals of $LiNbO_3$ having an inverted domain structure which converted the wavelength of a $YVO_4$ solid-state laser (oscillation wavelength: 1,064 nm) using a GaAlAs semiconductor laser (oscillation wavelength: 808.7 nm) as an excitation light source; and a laser from AlGaInP (oscillation wavelength: approximately 680 nm: Type No. LN9R20 manufactured by Matsushita Electric Industrial Co., Ltd.).

The three color layers were each moved in a direction perpendicular to a scanning direction by means of a polygon mirror so that successive scanning exposures of the sample were possible. Light quantity variation due to the temperatures of the semiconductor lasers was suppressed by keeping the temperature constant utilizing a Peltier element. The effective beam diameter was 80 μm, the scanning pitch was 42.3 μm (600 dpi), and the average exposure time per pixel was $1.7\times10^{-7}$ seconds.

After exposure, processing was carried out according to color development processing B. The results were the same as the results for high-intensity exposure in Example 1, and it was found that these photosensitive materials were also suitable for image formation by use of laser scanning exposure.

Example 6

Additional samples corresponding to the samples produced in Examples 1 to 5 were prepared by using ultraviolet absorbing agents UV-A' and UV-B', each obtained by replacing only UV-4 used in ultraviolet absorbing agents UV-A and UV-B (both were mixtures of ultraviolet absorbing agents) employed in Examples 1 to 5 with UV-8 in the same amount. The samples were evaluated for their effects as conducted in the above Examples. The results were the same as those obtained in Examples 1 to 5.

According to the present invention, there is provided silver halide grains, a silver halide emulsion and a silver halide color photographic photosensitive material, which are suitable for high-intensity exposure (digital exposure), have high pressure resistance during development, are capable of being processed at a high speed (mass processing), and with which can be realized a high-image-quality print system.

What is claimed is:

1. Silver halide grains, comprising:

95 mol % or more of silver chloride per total mol of silver and iodide ions present in a concentration having a maximum on the grain surface and attenuating toward the grain interior, including cubic grains or tetradecahedral crystal grains, and having a primary electron-trapping center exhibiting an average electron residence time of from 1/10,000 second to 1/100 second, wherein a difference in ionic conductivity between a region exhibiting highest ionic conductivity and a region exhibiting lowest ionic conductivity is at least 100 times.

2. The silver halide grains according to claim 1, wherein the silver halide grains have a primary electron-trapping center in the region exhibiting lowest ionic conductivity.

3. The silver halide grains according to claim 1, wherein an illumination-conversion dopant is incorporated inside the grains and/or on the surface of the grains.

4. The silver halide grains according to claim 3, wherein the illumination-conversion dopant is selected from the group of transition metal complexes consisting of $K_4IrCl_6$, $K_4Ir(H_2O)Cl_5$ and $K_4Ir(\text{thiazole})Cl_5$.

5. The silver halide grains according to claim 4, wherein the transition metal complex is incorporated in an amount of $1\times10^{-10}$ to $1\times10^{-2}$ mol per mol of silver.

6. The silver halide grains according to claim 1, which are silver iodobromochloride grains.

7. The silver halide grains according to claim 6, which have at least one of a localized silver iodide phase or a localized silver bromide phase.

8. The silver halide grains according to claim 1, further comprising a gold (I) compound having an organic ligand.

9. A silver halide emulsion comprising silver halide grains, wherein the silver halide grains contain 95 mol % or more of silver chloride per total mol of silver and iodide ions present in a concentration having a maximum on the grain surface and attenuating toward the grain interior, include cubic grains or tetradecahedral crystal grains, and have a primary electron-trapping center exhibiting an average electron residence time of from 1/10,000 second to 1/100 second, and wherein in the silver halide grains, a difference in ionic conductivity between a region exhibiting highest ionic conductivity and a region exhibiting lowest ionic conductivity is at least 100 times.

10. The silver halide emulsion according to claim 9, wherein the silver halide grains have a primary electron-trapping center in the region exhibiting lowest ionic conductivity.

11. The silver halide emulsion according to claim 9, wherein a silver iodochloride phase is provided on shell portions of the silver halide grains in an amount of 0.01 to 0.50 mol % per total mol of silver.

12. The silver halide emulsion according to claim 9, wherein a localized silver bromide phase is provided on the surface of the silver halide grains in an amount of 0.2 to 5 mol % per total mol of silver.

13. The silver halide emulsion according to claim 12, wherein the localized silver bromide phase contains a Group VIII metal complex.

14. The silver halide emulsion according to claim 9, wherein the silver halide grains are silver iodobromochloride grains.

15. The silver halide emulsion according to claim 14, wherein the silver halide grains have at least one of a localized silver iodide phase or a localized silver bromide phase.

16. The silver halide emulsion according to claim 9, wherein the silver halide grains further comprise a gold (I) compound having an organic ligand.

17. A silver halide color photographic photosensitive material comprising a silver halide emulsion that includes silver halide grains, wherein the silver halide grains contain 95 mol % or more of silver chloride per total mol of silver and iodide ions present in a concentration having a maximum on the grain surface and attenuating toward the grain interior, include cubic grains or tetradecahedral crystal grains, and have a primary electron-trapping center exhibiting an average electron residence time of from 1/10,000 second to 1/100 second, and wherein in the silver halide grains, a difference in ionic conductivity between a region exhibiting highest ionic conductivity and a region exhibiting lowest ionic conductivity is at least 100 times.

18. The silver halide color photographic photosensitive material according to claim 17, wherein the silver halide grains have a primary electron-trapping center in the region exhibiting lowest ionic conductivity.

19. The silver halide color photographic photosensitive material according to claim 17, wherein the silver halide grains are silver iodobromochloride grains.

20. The silver halide color photographic photosensitive material according to claim 19, wherein the silver halide grains have at least one of a localized silver iodide phase or a localized silver bromide phase.

21. The silver halide color photographic photosensitive material according to claim 17, wherein the silver halide grains further comprise a gold (I) compound having an organic ligand.

22. The silver halide color photographic photosensitive material according to claim 17, which is used for rapid processing and developed by employing a color developing time of from 6 seconds to 30 seconds.

* * * * *